US006011524A

United States Patent [19]

Jervis

[11] Patent Number: 6,011,524

[45] Date of Patent: Jan. 4, 2000

[54] INTEGRATED ANTENNA SYSTEM

[75] Inventor: James W. Jervis, Cupertino, Calif.

[73] Assignee: Trimble Navigation Limited, Sunnyvale, Calif.

[21] Appl. No.: 08/248,524

[22] Filed: May 24, 1994

[51] Int. Cl.[7] ..... H01Q 1/36; H01Q 11/08

[52] U.S. Cl. ..... 343/895; 343/859

[58] Field of Search ..... 343/895, 859, 343/872; H01Q 1/36, 11/08

[56] References Cited

U.S. PATENT DOCUMENTS

| | | | |
|---|---|---|---|
| 3,523,260 | 8/1970 | Gunshinan et al. | 333/26 |
| 3,771,070 | 11/1973 | Gaudio | 333/26 |
| 3,845,490 | 10/1974 | Manwarren et al. | 343/821 |
| 3,991,390 | 11/1976 | Conroy | 333/26 |
| 4,012,744 | 3/1977 | Greiser | 343/895 |
| 4,458,249 | 7/1984 | Valentino et al. | 343/754 |
| 4,475,111 | 10/1984 | Gittinger et al. | 343/895 |
| 4,737,797 | 4/1988 | Siwiak et al. | 343/859 |
| 4,739,289 | 4/1988 | Cripps | 333/26 |
| 4,755,820 | 7/1988 | Blackhouse et al. | 343/700 MS |
| 4,825,220 | 4/1989 | Edwards et al. | 343/795 |
| 4,847,626 | 7/1989 | Kahler et al. | 343/700 MS |
| 4,872,019 | 10/1989 | Chow et al. | 343/753 |
| 5,081,469 | 1/1992 | Bones | 343/895 |
| 5,134,422 | 7/1992 | Auriol | 343/895 |
| 5,148,130 | 9/1992 | Dietrich | 333/25 |
| 5,170,176 | 12/1992 | Yasunaga et al. | 343/895 |
| 5,191,352 | 3/1993 | Branson | 343/895 |
| 5,198,831 | 3/1993 | Burrell et al. | 343/895 |
| 5,255,005 | 10/1993 | Terret et al. | 343/895 |
| 5,319,374 | 6/1994 | Desai et al. | 342/387 |
| 5,343,173 | 8/1994 | Balodis et al. | 343/895 |
| 5,346,300 | 9/1994 | Yamamoto et al. | 343/895 |
| 5,349,365 | 9/1994 | Ow et al. | 343/895 |

OTHER PUBLICATIONS

*Transmission Line Design Handbook*, Waddell, B., Artech House, Boston, Mass 1991.

System Definition Manual, Inmarsat, vol. 3, Release 2.0 Apr. 1992.

*Antennas* by Kraus, John D., McGraw Hill Book Co., NY 1950.

*Handbook of Microwave Integrated Circuits*, Hoffman, R., Artech House, Norwood, Mass 1987.

*Primary Examiner*—Michael C. Wimer

*Attorney, Agent, or Firm*—Blakely, Sokoloff, Taylor & Zafman LLP

[57] ABSTRACT

Disclosed herein is a low profile quadrifilar helix antenna system having the non-fed ends of the helix conductor arms shorted to a first ground plane, the ground plane mounted below the helix. The first ground plane is mounted perpendicularly to the central axis of the helix and extends radially outward therefrom to form an effective electromagnetic shield between the helix and adjacent ground planes. The extension of the first ground plane combined with the shorted non-fed ends of the helix arms minimize the influence of placement of the antenna system near adjacent ground conductors on the VSWR performance of the antenna. The conical frustum geometry of the helix conductors is configured to provide a low profile, resonant antenna. An integrated signal conditioning network is mounted within a cavity defined between the first ground plane and a second ground plane below the first ground plane. The conductive elements of the network are thus shielded from influencing the radiation pattern of the antenna system. The perpendicular orientation of the electronics also provides an integrated antenna system having lower overall height. A refractive dielectric dome is provided enclosing the helix and electronics. The dome thickness and dielectric constant are selected to provide increased gain for the antenna system at low elevation angles, i.e. near the horizon.

4 Claims, 11 Drawing Sheets

INTEGRATED ANTENNA SYSTEM

BACKGROUND OF THE INVENTION

1. Field of the Invention

The invention relates to a small integrated antenna system for satellite communications. More particularly to low profile omni-directional satellite antennas having a compact height and relatively good VSWR immunity to adjacent grounding structures. The invention is particularly addressed to use in land-mobile position and locating systems.

The invention includes several novel features. These include a low loss refracting dome enclosing a top fed, dual bi-filar helix in the form of a conical frustum, having resonant arms shorted to a shielding ground plane. The helix is driven by a unbalanced to balanced feed network including a low loss shielded-suspended-substrate balun/splitter stripline-like circuit combined with the ground plane. The balun/splitter includes compensating balun arm lengths to achieve a uniform azimuthal radiation pattern. An efficient, level controlled, grounded base, Class C, power amplifier using an emitter bias current to control the base-emitter conduction threshold. The emitter current bias input is controlled from a directional coupler sampling the transmitted forward power.

The electronics are integrated directly into the antennas ground plane structure and shielded from the radiating helix to form very compact and efficient antenna system. This provides a structure which meets stringent radiation pattern requirements for INMARSAT satellite communications. The combination of the helix frustum shape and refracting dome provide a uniform radiation pattern in elevation. The conical structure with integral ground plane provides a system having reduced height and reduced VSWR sensitivity to the effects of mounting on vehicle rooftops.

2. Background of the Invention

In long-haul shipping, speed, timing and punctuality are critical factors for successful companies. Delivering cargo exactly where it needs to go, on time, requires the ability to communicate with every vehicle in a fleet, at all hours of the day, anywhere in the world. Mobile satellite communication systems have been combined with satellite position locating systems to use in marine shipping and in long-haul trucking. Long haul trucking in particular requires mobile communication/position locating units having light weight, low profile antenna systems.

PREVIOUS ART

The previous art for satellite communications operation focused on systems for the marine environment in which antenna height and weight of the mobile unit was not of great concern. Ships typically have masts and other structures for mounting antennas, which renders antenna height and mass of less importance.

A description of a satellite position locating system is the Global Positioning System (GPS) described in U.S. patent application Ser. No. 08/011988 filed Feb. 2, 1993 by Simon, Desai and MacKnight, James and herein incorporated by reference.

A description of satellite communications system requirements is the lnmarsat-C system described in *System Definition Manual* (SDM), Inmarsat, Volume 3, Module 4, Release 2.0, April 1992.

The INMARSAT-C communications system consists of a network of geo-synchronous communication satellites and Land Earth Stations (LES) for communicating to mobile transceiver/antenna units. These provide the capability of nearly global communications. The mobile units in the INMARSAT-C system operate at a transmit frequency band of 1626.5–1646.5 MHz and a receive frequency band of 1530–1545.0 MHz. Messages are coded using a convolutional, interleaved code and transmitted at a information rate of between 300–600 baud depending on the satellite generation. Specifications on antenna gain, pattern shape and noise have been established to meet the signal error rates required by the INMARSAT system.

The requirements of the INMARSAT communications system are described in the SDM-GMDSS specification op cit. The pertinent requirements are summarized in the graphs shown in Ship Earth Station Requirements, FIGS. 4-2 and 4-3, op cit and repeated herein as FIG. 10 and FIG. 11.

The required performance of the transceiver/antenna system of the mobile units are summarized (1) by the minimum of the ratio of Gain G, to the equivalent noise temperature T, the profile of G/T with respect to azimuth and elevation, and (2) the minimum and maximum effective isotropic radiated power (EIRP) profile with respect to azimuth and elevation. The gain G is in dB (10 times log power ratio) referred to a right-hand circularly polarized isotropic antenna. Noise temperature T is in dBK relative to 1 degree Kelvin. T is calculated as 290*(F−1), where F is the noise factor. Noise factor F is defined by Si/Ni/(So/No), where Si=signal power available at input, Ni=noise power available at input at T=290 degree K, So=signal power available at the output, and No=noise power available at the output.

The pertinent noise temperature T, for a receiver connected to an antenna includes the low-noise background of empty space, modified by the surrounding terrain or sea surfaces and atmosphere at about 290 K, the noise contributed by the sun at several thousand degrees K and any man-made noise within the bandwidth of interest. Noise received by the antenna must be added to the noise from conductive and dielectric losses in the antenna structure itself, the losses of any networks or matching circuits connecting the antenna to the receiver and the input noise of the receiver.

The minimum G/T and EIRP profiles are specified as circularly symmetrical about the zenith (90 degree elevation). G/T is not defined for elevation angles from −15 degrees to −90 degrees. The minimum G/T is determined by the desired error rate of signals received by the mobile unit which are transmitted from any one of the INMARSAT-C satellites.

The minimum G/T at 5 degrees elevation is −23 dBK and −24.5 dBK at 90 degrees elevation. The minimum EIRP at 5 degrees elevation is 12 dBW and 10.5 dBW at 90 degrees elevation. The maximum EIRP is 16 dBW for all elevation angles from −90 degrees to +90 degrees and all azimuth directions. The maximum EIRP is determined by the maximum allowable number of active communication channels and the minimum power available from any INMARSAT-C satellite.

These specifications define a window in which a combined communications/positioning transceiver system must operate. The receiver function of the system is bounded by the minimum required G/T profile and the transmit function of the system is bounded by the minimum and maximum EIRP profiles.

The features of the combined transmit/receive system which must be considered are primarily these: 1) the deviation of the gain profile of the particular antenna over azimuth and elevation from that of an isotropic antenna;2) the deviation of the antenna gain profile over the frequency band of interest from a constant value; 3) the background noise, signal losses and noise contributed by the physical antenna and matching circuitry prior to the first stage of amplification; 4) the noise contributed by the first gain stage; 5) the mismatch losses contributed by impedance mismatch between the antenna elements, the matching circuitry and the input to the first gain stage; 6) the mismatch losses contributed by conductive surfaces nearby the antenna mounting.

Achieving the above electrical performance constraints while minimizing physical height and weight for a land mobile communication/position locating antenna system is the objective for a series of innovations that are provided by the present invention and which are described and claimed below.

One example of a previous integrated satellite positioning and communications mobile unit designed for marine service is the "GALAXY INMARSAT-C/GPS TNL 7001" made by Trimble Navigation of Sunnyvale, Calif. The system is partitioned into two separate enclosures. The antenna, receiving preamplifier and transmitting power amplifier are mounted in an integrated antenna housing 207 mm high by 172 mm in diameter, weighing about 2 kg. The antenna housing and electronics may be separated from an associated transceiver and display panel by as much as 30 meters with a large diameter RF cable. The TNL 7001 includes a thin (about 0.080 inches thick) egg-shaped dome enclosing two cylindrical, resonant, orthogonal bifilar helices. Also within the dome is a conical ground plane mounted below the helices. A inverted, T-shaped ¼ wave balun is oriented along the axis of the helix and mounted within the internal volume of the helix. The ¼ wave balun is made of parallel, semi-rigid transmission lines. The dome, helices are oriented along an axis directed toward the zenith. The orientation of the balun and cylindrical helix cause the antenna to have an extended axial aspect. A quadrature power splitter is provided to feed the balun. The balun feeds the two orthogonal bifilar helices with equi-amplitude quadrature phase RF signals to produce and receive circularly polarized radiation in a cardioid pattern having nearly hemispheric symmetry.

The antenna housing of the "TNL 7001" is ideally suited to mount at the end of a vertical pole or a mast on the superstructure of a ship. The signals supplied to and from the integrated antenna/electronics combination are conducted by the cable to the remotely mounted transceiver. The height and weight of the "TNL 7001" is suitable for marine service but is larger than desired, however, for mounting on the roof of a truck. It would be an advantage to provide an antenna system having a lower profile, while retaining the simple two assembly configuration of the "TNL 7001".

A land mobile integrated satellite communication, position locating system is the "TT-3002B CAPSAT MINIROD" made by Thrane and Thrane of Soborg, Denmark. This system is partitioned into three separate enclosures; an antenna, an electronics module and a signal processing and display module. The antenna is enclosed in a frustum (truncated cylindrical cone) 110 mm high by 48 mm diameter. The microwave electronics, including a low noise/high power amplifier (LNA/HPA), are placed in a separate assembly which must be sited no more distant than one meter from the antenna and connected by a low loss cable. The cable loss is limited to about 1 dB in order to meet the Inmarsat-C G/T specification.

The third assembly contains the signal processing and display electronics, and may be connected by a longer, more lossy cable and placed some additional distance from the LNA/HPA. The "MINIROD" system provides a lower antenna profile at the penalty of an additional enclosure that must be mounted near to the antenna. It would be an advantage to provide an antenna system having a low profile with only the antenna and one other remotely mounted enclosure for the signal processing and display electronics.

Mounting mobile antenna systems on trucks can be problematic with regard to height and weight and connecting cabling as described above. Previous art systems have partitioned the system, as described above, into essentially three constituent assemblies connected by cabling; the antenna mount including some matching circuitry; a second assembly including low noise preamplifier and transmitter power amplifier circuitry; and a third assembly including the signal processing and display unit. Mounting of the antenna and the second container is problematic because of height, weight and cable length constraints. The losses of the cable, connecting between the antenna and the second container, decrease the gain and increase the equivalent input noise of the system resulting in reduced G/T performance.

Turning now to a discussion of the partitioning of the system into different enclosures, the antenna is discussed first below.

Quadri-filar, helical antenna elements are generally used in satellite antenna systems. The four filar elements are disposed as two orthogonal bifilar pairs having the same length, pitch and height, wound about an axis, producing an antenna with quadrilateral symmetry. Each element is fed with equal amplitude rf signals. The rf signals to each element are arranged to be in successive phase quadrature with each other, corresponding to the angular quadrature and are usually fed from the top or bottom of the four quadrature elements. The helical antenna is oriented having the axis generally perpendicular to the earth, a bottom plane parallel to the earth, with the top of the antenna directed outward along a radius from the earth. Quadri-filar-helical antennas have the advantage of having a radiation pattern which has a cardioid shape about the central axis. This pattern is nearly omni-directional and relatively uniform over the hemisphere symmetrical about the central axis of the helix. This is of considerable advantage in satellite communications in which the relative horizontal and vertical angles between a mobile transmitter/receiver and a communications satellite take a wide range of values.

Mobile satellite communications systems use circularly polarized radio waves. Helical antennas also have low axial ratios, i.e. near unity, which are well suited for receiving circularly polarized waves. Axial ratio is defined as the ratio of signals received by the antenna from radio waves having equal intensity, and with orthogonal polarization. Helical antennas are described in the book "*Antennas*" by John D. Kraus, McGraw Hill Book Company, 1950, chapter 7, pages 173 to 216 incorporated herein by reference.

RF signals supplied to, or received from the helical antenna may be connected in a number of ways. Frese, U.S. Pat. No. 5,146,235 shows a helical antenna arranged within a closed housing which is permeable to HF radiation. The UHF signal is supplied to an end of the helical antenna through a coaxial connector. The other end of the radiating element is open. Diameter, height and total length of the antenna wire are very small in comparison to the wave length. The impedance of the antenna is a function of the frequency, the helix length, the pitch and number of turns.

To achieve low overall height and reasonable impedance to feed the antenna, it is an advantage to use antennas near resonance, i.e. having a helix length an even quarter multiple of radiating wavelength. In the text by Kraus, for example, for antennas whose helical length is an even multiple of quarter wavelength, to bring the impedance at the feed point back to a reasonable value, it is necessary to short the ends of the antenna. The traditional method is to bring the ends radially inward either at the top or bottom, in a X, and short them in the middle, or to leave the ends open. Leaving the ends open typically is not done because an efficient high frequency open circuit is difficult to achieve, whereas the impedance of high frequency short circuits can be well controlled.

This approach is disclosed by Yasunaga, U.S. Pat. No. 5,170,176. Yasunaga discloses a cylindrical quadrifilar helix which incorporates linear conductors extending axially from one or both ends of the helix. The ends of the linear conductors are shorted in an X, or left open. The linear conductors provide improved axial ratio performance to the antenna with a corresponding increase in overall height.

FIG. 3 shows a prior art helix antenna following Yasunaga. In the figure, the numeral 21 is a feed circuit, 30 through 36 are helix conductors, 40 through 46 are feed conductors, and 45, 47 are linear conductors crossing at a central axis 38 and shorted at the mid point in an X configuration. Yasunaga discloses the antenna as located in free space, removed from nearby ground planes and is silent on the effects of mounting the antenna near to an adjacent ground. The helix conductors 30 through 36 are fed with RF signals having equal amplitude and successive phase differences of 90, 180, and 270 degrees respectively, in comparison with conductor 30, and the antenna radiates circularly polarized waves. The shape of the antenna is defined by the pitch length of the helix conductors, the length of the feed conductors (which sets the diameter, D1, of a first circle containing the top ends of the helix conductors 40–46), the length of the shorting conductors (which sets the diameter of a second circle, D2, containing the bottom ends of the helix conductors 40–46), the number of turns of the helix conductors and the height of the antenna between the top and bottom ends of the helix conductors. One example of each of those parameters for achieving a broad band, almost hemispherical beam at an operating wave length $\lambda$ are a height H of 0.5 $\lambda$, a helix conductor length L1, of 0.925 $\lambda$, a feed conductor length L1 of 0.075 $\lambda$, a shorting conductor length D2 of 0.43 $\lambda$, and ¾ turns pitch.

Herein lies the problem. In designing a short antenna which is to be mounted close to a metal surface, the helical elements typically are considered as isolated from ground. In particular, the bottom ends of the helical elements are typically isolated from ground. The performance characteristics predicted for the antenna are calculated under this assumption. The problem is in actual use where the antenna is typically mounted on or near a conducting ground. The proximity between the radiating helical elements and the adjacent ground, in actual operation, may cause the actual voltage standing wave ratio (VSWR) at a feed point, or input, to be significantly different from the design value which is calculated as though the antenna were in free space. The change of VSWR between design and actual operation can cause lower radiated power efficiency, lower antenna gain and increased noise at the input to the antenna. It would be an advantage to have a shortened antenna structure having a ground structure that provides a reduced sensitivity of VSWR due to changes in the spacing of the antenna to adjacent grounds.

With reference to FIG. 3A there is shown a schematic of the equivalent circuit of a combining and matching network 72 which is used to convert from the four phase balanced configuration of the feed circuit 21 of the previous art helix antenna to a coaxial unbalanced network typical of that used in the art. The network 72 includes circuit elements having an equivalent shunt inductance L of 148 nH, across the impedance Z of the antenna, and an equivalent series capacitance C of 0.83 pF to an input 74 of the matching network. The impedance Z of the antenna, network combination at wavelength $\lambda$ of FIG. 3 in free space is measured at the input 74 to the network 72 when the antenna is isolated from ground. The impedance under this condition is 332+j46 ohms. This matching network transforms the antenna impedance Z to an impedance of 50+j0 ohms at the input 74 to the matching network 72. When the antenna impedance and matching network 72 are connected to a signal source or receiver of 50 ohms impedance, there will be no reflected signal and therefore no signal power loss experienced in either transmission or reception of signals by the antenna. In other words, the VSWR at the input to the matching network will be 1.0.

However, if the antenna of FIG. 3 is placed adjacent to a ground plane, eg. 0.1 inches away, the influence of the ground plane on the electric field pattern will be such as to cause a change in the antenna impedance Z to 600+j165. The mismatch with the circuit of FIG. 3A will cause the VSWR at the input to the matching network to increase to 1.97:1. This is equivalent to an antenna gain loss of 0.5 dB and subtracts directly from the antenna gain G and the signal power available from the antenna. For a given antenna size, the gain will decrease. Alternately, for a given gain, the antenna size must be increased. It would be an advantage to reduce the loss caused by VSWR mismatch whereby antenna size could be reduced.

Broad band helical antennas having non-uniform diameter sections are known to improve the bandwidth of helical antennas. Wong, U.S. Pat. No. 4,169,744 discloses single element helical antennas having a radiating element open at the non-fed end, having sections of different diameter connected by other, tapered sections. The different diameters and tapered sections provide improved bandwidth for good gain, low VSWR and good axial ratio. A typical example shows peak gain of 13–14 dB from 700 to 1100 MHz, an axial ratio of about 1 dB and a VSWR of about 1.3 dB. The disadvantage with this approach is the length of the multiple multi-turn helices which leads to large over all height. A preferred embodiment in Wong is shown as 56 inches high. Wong discloses mounting the base of the antenna in a upward facing open cavity of large overall dimension, eg 11.25 by 3.75 inches. It would be an advantage to have an antenna having high performance with reduced overall dimensions.

Wong is silent on the effect of the mounting cavity on VSWR performance for operation in free space or near adjacent grounds.

Greiser, U.S. Pat. No. 4,012,744 discloses a combination bifilar spiral and helical antenna to achieve a broad bandwidth from 0.5 to 18 GHz. The bifilar spiral portion is centered on the top of a top-hat shaped antenna, with the bifilar helix arms forming the vertical crown of the hat. The outer ends of the spiral arms connect to the corresponding upper ends of the helix arms. A ground plane extends outward from the bottom of the antenna as the brim of the top-hat. The bottom ends of the helix arms are connected to the conducting brim by means of resistive elements to terminate the helix arms. The inner ends of the spiral arms are fed from an internally mounted transmission line and rectangular balun box. The conductive balun box is therefore coupled to the radiation field of the antenna.

Several disadvantages are presented by this structure. The addition of resistive elements connected between the bottom end of the helix elements and the ground plane cause increased noise and loss in the bandwidth of interest. The presence of the conductive balun box within the radiating field of the antenna can cause undesired resonances in the frequency band of interest. Greiser discloses that these resonances may be suppressed by additional lossy components such as absorbers within the helix, or by adding metallic vanes. The addition of other conducting surfaces such as metallic vanes to suppress resonances can cause disturbances to the otherwise uniform radiation pattern of the helical antenna.

It would be an advantage to provide a helical antenna which did not require additional resistive or metallic elements which induce noise and loss in the antenna and which eliminated the influence of the balun electronics from the symmetry of the radiation pattern of the antenna.

Burrell et al U.S. Pat. No. 5,198,831 discloses a quadrifilar helical antenna with integrated power splitting and preamplifier circuitry. The helices and the circuitry are formed on a single dielectric substrate which is wound into a tubular shape. The substrate includes upward extending, outward facing helical arms, an outward facing shield section and the circuitry mounted on an inward facing surface of the substrate. Rf signals are capacitively coupled to the outward facing helical arms by corresponding inward facing arms connected to power splitting circuitry. The shield section and circuitry extend axially below the bottom end of the outward facing radiating helix arms. The outward facing shield section provides a grounding connection for the bottom ends of the outward facing arms. An internal support and grounding disk within the tubular shield section is soldered to the upper end of the ground shield to provide additional shielding between the antenna arms and the circuitry mounted below the support disk.

The disadvantage of this structure is the downward axial extent of the substrate, shield and electronics below the bottom of the helical arms which leads to an increased overall height for the antenna for a given helix shape.

Also, the shielding effect of the grounding support disk on the radiation pattern of the antenna relative to adjacent ground surfaces is terminated by the outer diameter of the tubular substrate. Electric field lines from the helix elements are therefore not completely shielded from external ground surfaces.

It would be an advantage to have the power splitting and matching circuitry oriented to reduce overall antenna height and to improve the shielding effect of the ground shield and disk.

The power splitting and matching circuitry in Burrel is implemented in microstrip circuit patterns between the feed point of the antenna helix elements and the preamplifier. The placement of the preamplifier immediately after the splitting and matching circuitry helps to increase the gain (G) and lower the effective noise temperature (T) of the antenna and amplifier system from that of a system using a relatively lossy cable to connect between antenna and preamplifier. However, the performance of the system is limited by the loss of the microstrip circuitry itself. A significant part of this loss is contributed by the fringing of electric field lines in the dielectric material of the substrate carrying the conductors of the circuitry.

It would be an advantage to improve the system performance as measured by the G/T ratio by decreasing the loss of the circuitry between the antenna helix elements and the input to the first preamplifier stage.

Auriol, U.S. Pat. No. 5,134,422 discloses helical antennas of both cylindrical and conical shape having integrated strip line power splitting and impedance matching circuitry. This also discloses the circuitry mounted on the same substrate as the helical arms. The substrate and circuitry extend along the conical surface of the antenna below the upward extending helical arms. The power splitting and impedance matching circuitry is connected between the ends of the helices and the input of a preamplifier stage.

The G/T of the antenna and circuitry are determined primarily by the gain of the helix, the gain (G) and noise figure (NF) of the preamplifier and the loss of the circuitry between the helix and preamplifier.

This structure has the disadvantage of increased overall antenna height due to the downward extent of the circuitry below the bottom ends of the helical arms. The integrated circuitry also remains within the radiating field of the helical arms and no shielding is provided between the helix and nearby mounting surfaces.

It would be an advantage to have the power splitting circuitry oriented to reduce antenna height, to be shielded from the helix and to provide circuitry with loss characteristics which are improved over that of the strip line.

The helix antenna may be characterized as a quadri-filar antenna having quadrilateral symmetry, or as two bi-filar antennas mounted orthogonally to each other. In either case, in order to preserve a radiation pattern that approaches hemispherical uniformity in azimuth and elevation, the four adjacent helical elements must be fed in nearly equal amplitude and quadrature phase relationship over the frequency band of interest. Since the antenna is typically fed from a coaxial connector, there is generally a power splitter and balun provided between the coaxial connector and the helical elements. Stripline and microstrip baluns for providing power splitting, balanced output signals and phase shift from an unbalanced input are disclosed, for example, in Gaudio, U.S. Pat. No. 3,771,070; Conroy, U.S. Pat. No. 3,991,390; Cripps, U.S. Pat. No. 4,739,289; Edward, U.S. Pat. No. 4,800,393; Kahler, et al, U.S. Pat. No. 4,847,626 and Dietrich, U.S. Pat. No. 5,148,130.

The loss characteristics of microstrip and stripline circuits are a result of two factors; 1) those associated with the resistive losses of conduction currents in the transmission line patterns and the nearby ground planes, and 2) those associated with dielectric losses in the dielectric substrate supporting the transmission line patterns caused by the electric field lines between the transmission line patterns and the ground planes. Reduction of losses are conventionally achieved by using high quality (and thereby costly) materials, such as, gold plated conductors, quartz or sapphire substrates, and the like; or using wave-guide like circuit components which are impractical for small, microwave integrated circuits.

It would be an advantage to provide lower loss integrated power splitting and impedance matching circuitry for a helix antenna which used lower cost materials.

It is desired to have quadri-filar helix satellite communication antennas of minimum height as discussed above. One method of reducing height while retaining the desired resonant helix element length, is to form the helix in the shape of a frustum having a larger diameter base and a narrow diameter top. The limit to the degree to which the frustum can be flattened out is determined by the tendency for the elevation profile to have decreased gain toward the horizon relative to the zenith. In the limit, a flattened spiral would have no gain directed at the horizon. It would be an advantage to compensate the loss of gain toward the horizon as the aspect ratio of the frustum becomes more conical and less rectangular thereby becoming shorter.

The present invention is directed toward satisfying the needs described above.

SUMMARY OF THE INVENTION

It is an object of the invention to provide a integrated quadrafilar helix antenna system having a reduced overall height for a given G/T and EIRP performance requirement.

It is also an object of this invention to provide an antenna system having reduced VSWR sensitivity to mounting on an adjacent ground plane It is another advantage of this invention to provide an antenna system having integrated balun and quadrature splitter circuitry with reduced dielectric loss.

It is further an advantage of this invention to provide an antenna having an improved conductive shield between the circuitry and the helical radiating conductors to minimize distortion in the radiation pattern of the antenna.

It is further object of this invention to provide a means to compensate for azimuthal pattern asymmetry caused by asymmetry of one or more of the antenna system components.

The low profile, helical antenna system according to the invention has a helix formed of four spaced apart helical conductors wound in a common winding direction. The helical conductors, each having a top end and a bottom end define a common central helix axis, with the central axis aligned generally toward the zenith.

A ground plane is provided perpendicular to the helix axis. The ground plane defines a top surface, proximal to and below the bottom ends of the helical conductors. The ground plane extends radially outward at least a preselected distance from the central axis beyond the bottom ends of the helical conductors, and is configured to terminate a major portion of electric field lines from the helical conductors.

Conductive connections are provided connecting the respective bottom ends of the helical conductors to the ground plane.

A signal feed means is provided for coupling four balanced RF signals from the common central axis to the top ends of corresponding helical conductors. The signal feed means having a circuit point having an preselected impedance with respect to the ground plane.

The ground plane provides a conducting shield for terminating electric fields lines from the helix conductors such that the VSWR at the circuit point of the signal feed means of the helix antenna has a preselected maximum value when the helix antenna is mounted a preselected distance parallel to and above another ground plane conductor, such as a vehicle rooftop.

This configuration of the helix and ground plane can be selected to provided low VSWR such that, mismatch losses cause by mounting the antenna near adjacent grounds can be essentially zero, in contrast to previous art helix systems.

The helical antenna may have each helix conductor contained in a cylindrical surface rotationally symmetric around the central axis. Alternately, each helix conductor may be contained in a conical surface rotationally symmetric around the central axis.

In a preferred embodiment of the low profile antenna system, the radial distance the ground plane extends beyond the bottom ends of the helical conductors is at least 0.21 times λ, and provides a maximum VSWR at the circuit point of the signal feed means of 1.09:1 when the antenna ground plane is within 0.1 inches parallel to and above another ground plane conductor.

One preferred embodiment of the helix antenna in accordance with this invention for operating at a wavelength λ, includes the helix having a height between the top and bottom ends of the conductors, being 0.5 λ, the length of the each helix conductor between the top end and the bottom end being 0.925λ, the length of each of the feed conductors between the inner ends and the outer ends of the feed conductors being 0.075λ, and presents a balanced resonant impedance at the inner ends of opposed pairs of feed conductors.

A preferred embodiment of the low profile antenna in accordance with this invention includes a dome enclosure of a dielectric material. The enclosure has a proximal opening to receive the helix antenna, and the opening is configured for mounting to the top surface of the ground plane. The enclosure is configured to fully encompass the helix antenna between the ground plane and a hemisphere, the hemisphere including the zenith, the hemisphere subtending the ground plane and the central axis. The enclosure has a top end distal from the proximal opening, and a height therebetween. The enclosure has a preselected thickness between an inner surface and an outer surface. The enclosure acts as a refracting lens for incident and transmitted RF signals, such that the enclosure thickness and dielectric constant selected to provide a preselected increased gain, relative to the helix antenna without the encompassing enclosure, at a preselected elevation angle from the zenith.

In a preferred embodiment the dome enclosure has a dielectric constant of about 3.5, and a thickness of about 0.2 inches and is molded from a blended polyester-polycarbonate co-polymer resin known as "XENOY 5220U".

In an additional aspect of the low profiled helix antenna system, there is included a second ground plane having a second top surface and a second bottom surface and a thickness therebetween. The second ground plane is mounted below the first ground plane. The first and second ground planes are configured to define a first planar cavity between a recessed portion of the bottom surface of the first ground plane and a second planar cavity between a corresponding recessed portion of the top surface of the second ground plane. A signal conditioning circuit including means for impedance matching and power splitting the RF signals to and from the helix is mounted parallel to the ground planes and inside the cavity.

A transmit/receive board including a low noise preamplifier means for amplifying RF signals from the signal conditioning circuit, is mounted below and parallel to the second ground plane. The amplifier means has a predetermined gain and noise figure, which provides a preselected G/T value for the antenna system.

A conducting planar cover plate defining a base plane distal to the antenna, and a third cavity recessed from the upper surface of the cover plate, is configured to receive the planar transmit/receive circuit board.

A coaxial cable connector is provided for connecting the amplified RF signals from the preamplifier means to a proximal end of a coaxial cable. The cable connector is mounted below the lower surface of the transmit/receive board, and projects axially through the cover plate.

In combination, the dimensions of the helix and the dome, the signal splitting and the signal conditioning circuit, transmit/receive board defines an overall height between the top end of the enclosure and the cover plate base plane of about 127 mm;

In combination, the antenna system also provides a system having a G/T profile which meets the SDM specifications measured at the distal end of a cable, including up to 10 dB of cable loss between the cable distal end and the cable proximal end.

There is also included a novel shorted suspended strip transmission line network for guiding an RF signal an input and at least one output. The strip line network includes, two parallel ground planes defining a cavity therebetween, a planar dielectric sheet, the sheet supported within the cavity, spaced apart from and between the two ground planes. A first conductive pattern including a first plurality of contiguous strip conductors is formed on the top surface of the sheet. A second conductive pattern formed on the bottom surface of the sheet, the second pattern including a second plurality of contiguous strip conductors. The second plurality of conductors overlays and essentially replicates the first pattern, thereby defining the strip transmission line network.

The sheet defines a plurality of sequential spaced apart feed through holes along at least a portion of the strip transmission line network. The through holes are successively separated by at most a maximum spacing distance d. The distance d is arranged to be less than a pre-selected submultiple of the wavelength corresponding to the RF signal frequency f, each successive spaced apart through hole contains a plated through conductor therethrough, and electrically joins the corresponding first and second conductive patterns around the each through hole, thereby defining the shorted suspended substrate transmission line.

An RF signal, impressed between the patterns and the ground planes will induce essentially zero RF electric field in the dielectric sheet between the overlaying first and second strip conductors thereby minimizing RF dielectric loss within the sheet, along the shorted suspended substrate transmission line.

The shorted suspended-substrate transmission line reduces loss in the circuitry prior to the first amplifier stage, thereby improving the G/T of the low profile antenna system. In a preferred embodiment, the maximum spacing d is about 1/50 of the RF signal wavelength.

Another unique feature of the low profile antenna system is the use of a balun having compensated ½ wave balun arms. A suspended strip transmission line dual balun network for transforming two equi-amplitude, unbalanced, quadraphase RF signals at a wavelength $\lambda$ into a first and a second equi-amplitude, balanced, quadraphase RF output signals, is provided. The compensated balun includes, two parallel ground planes defining a cavity therebetween, a planar dielectric sheet supported within the cavity, and spaced apart from and parallel between the two ground planes. A first strip transmission line is formed on the top surface of the sheet, the first line having an input end and an output end, and a first electrical length therebetween, which provides a half wave phase shift between the input end and output end.

A second strip transmission line is formed on the bottom surface of the sheet, the second line having a second input end and a second output end and a second electrical length therebetween. A first pair of feedthroughs is disposed on the first diagonal corners of a quadrate equilateral, the feedthroughs penetrating the substrate therethrough, the equilateral defined in the plane of the sheet, the input end and output end of the first strip line each connected to a respective one of the first opposed pair of feedthroughs on the top surface of the substrate, the first pair of feedthroughs thereby defining the first balanced output signal;

a second pair of feedthroughs disposed on opposed diagonal corners of the quadrate equilateral. The second pair of feedthroughs penetrates the thickness of the substrate therethrough. The input end and output end of the second strip line are each connected to a respective one of the second opposed pair of feedthroughs on the bottom surface of the substrate.

The second strip transmission line electrical length is selected to compensate for the additional length of the feedthroughs. The second strip length is such that the sum of the second electrical length plus the electrical length of the second pair of feedthroughs through the thickness of the sheet provides a half wave phase shift between the second pair of feedthroughs at the top surface of the sheet, thereby defining the second balanced output signal.

The first and second RF output signals will thereby appear as balanced, equi-amplitude, quadrature phase signals across the opposed diagonals of the quadrate equilateral.

The compensating balun provides a means to correct azimuthal pattern non-uniformity otherwise caused by unequal electrical path length along the balun lines. To a first order, the compensating balun can correct for additional azimuthal non-uniformity caused by other components of the system, specifically, that cause by a rotationally asymmetric helix enclosure.

BRIEF DESCRIPTION OF THE DRAWINGS

For a further understanding of the objects and advantages of the present invention, reference should be had to the following detailed description, taken in conjunction with the accompanying drawings, in which like parts are given like reference numerals and wherein.

DETAILED DESCRIPTION OF AN EMBODIMENT OF THE INVENTION

Figures 1, 2:
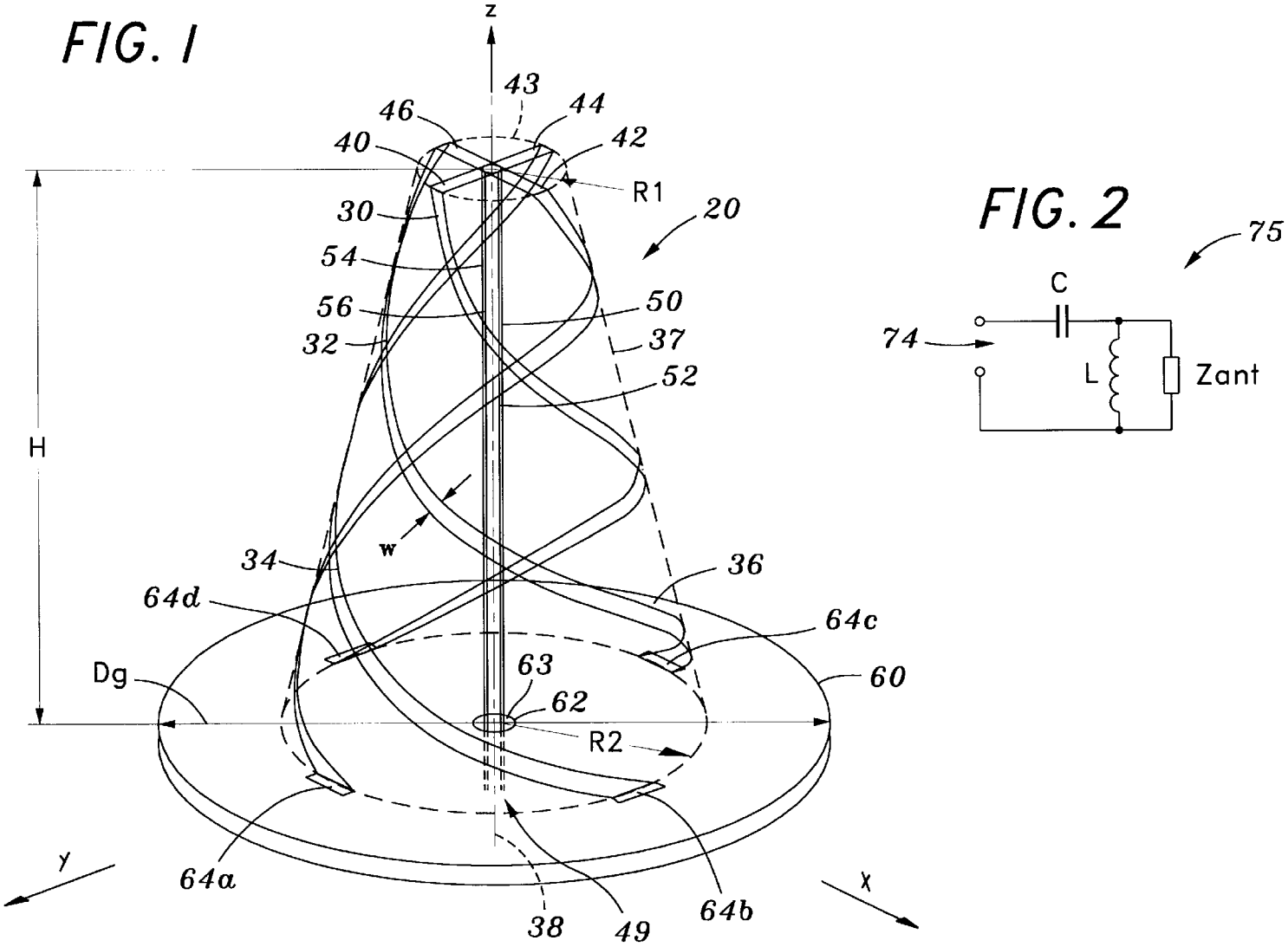
FIG. 1 is a perspective view of a conical quadrafilar helix antenna having an integrated ground plane in accordance with this invention.
FIG. 2 is a schematic of an equivalent circuit for matching and balancing RF signals to and from the antenna helix of FIG. 1.

With reference to FIG. 1, there is shown an embodiment of a quadrafilar helix antenna 20 according to the present invention. In the figure, the antenna has four spaced apart helix conductors 30, 32, 34, and 36 each having a pitch length L1 between a top end and bottom end respectively. The conductors 30 through 36 are wound in the same winding direction, and define a common central axis 38. The axis 38 is located on a z-axis of an xyz coordinate system. The top ends of the conductors 30–36 lie in a first plane perpendicular to the central axis 38. The top ends are disposed in quadrilateral symmetry and are equally spaced from the axis 38 by a distance R1. The top ends of conductors 30–36 thereby lie on a first circle having a diameter D1=2*R1 in the first plane, the first circle centered on the central axis.

The bottom ends of the conductors 30–36 lie in a second plane perpendicular to the central axis 38. The bottom ends of conductors 30–36 are disposed in quadrilateral symmetry and are equally spaced from the central axis 38 by a distance R2. The bottom ends of conductors 30–36 thereby lie on a second circle having a diameter D2=2*R2 in the second plane, the second circle centered on the central axis.

The top ends and bottom ends of conductors 30–36 are spaced apart a distance H along the axis 38.

The helix conductors 30–36 are configured to form two orthogonal bifilar helix pairs disposed about the axis 38. In a preferred embodiment of the invention, the height h of any point along one of the conductors 30–36 is a linear function of the angle between a first reference plane defined by the point and the central axis 38, and a second reference plane defined by the bottom end of the respective conductor and the central axis 38. The radial distance r from any point along one of the conductors 30–36 is also a linear function of the angle between the first reference plane defined by the point and the central axis 38, and the second reference plane defined by the bottom end of the respective conductor 30–36 and the central axis 38. The resulting helix of the antenna 20 is referred to as a linear helix as opposed to a logarithmic or archimedean helix also known in the art.

Four feed conductors 40, 42, 44, 46 of length L2, each having an inner end and an outer end are perpendicular to each other and to the z-axis. The feed conductors 40 through 46 lie in the plane containing the top ends of the conductors 30–36. The outer ends of each one of the feed conductors 40 through 46 is electrically connected to the respective top end of one of the helix conductors 30 through 36 by a conductive means (not shown).

A feed network, generally indicated by the numeral 49, for the feed conductors 40–46 includes four spaced apart feed rods 50, 52, 54, 56. Each rod 50–56 is oriented parallel to the z-axis having a top end and a bottom end, respectively. The feed rods 50–56 are disposed in quadrilateral symmetry about the central axis 38. The top end of each feed rod 50 through 56 is electrically connected to the respective inner end of one of the feed conductors 40 through 46 by a conductive means such as metal screws (not shown). The bottom end of each feed rod 50 through 56 extends below the bottom ends of the helix conductors 30 through 36.

The feed rods 50–56 are suitably sized and spaced sufficiently close to one another to act primarily as balanced transmission lines carrying signals from one end to the other.

A conductive ground plane member 60 is located below and adjacent to the bottom ends of the helix conductors 30 through 36. The ground plane member 60 is perpendicular to and intersects the z-axis. The ground plane member 60 is provided with an opening 62 generally centered on the z-axis for the bottom ends of feed rods 50 through 56 to project therethrough. An electrically insulating mechanical support 63 within opening 62 may be provided for the feed rods 50 through 56.

Conductive connections 64*a*–64*d* are individually provided between the bottom end of each helix conductor 30 through 36 and the ground plane member 60. The conductive connections 64*a*–64*d* provide respective RF shorts between the respective bottom ends of conductors 30 through 36 bottom ends and the ground plane member 60.

The ground plane member 60 extends radially outward beyond the ground connections 64*a*–64*d* to at least a diameter Dg. The diameter Dg is selected to be sufficient to shield substantially all the electric field lines (not shown) from the conductors 30–36 to adjacent conductive planes (not shown) mounted below the ground plane member 60. The extended ground plane member 60 thereby reduces the influence of adjacent ground surfaces on the VSWR at a reference feed point of the antenna 20.

The feed network 49, including the feed rods 50 through 56, provides RF signals to the feed conductors 40–46 in equal amplitude and successive pi/2 phase relationship by suitable signal source means (not shown) as is well known in the art and discussed further below.

In a preferred embodiment in accordance with this invention, the helix conductors 30–36 are supported by a substrate sheet 37 formed as a conical frustum. The frustrum 37 has a height H, an upper diameter D1 and a lower diameter D2. A preferred material for the frustum 37 is a low loss insulating material such as "KAPTON", a polyimide film made by Dupont Films Enterprise, Wilmington, Del. The helix conductors 30 through 36 are formed from a conductor such as copper deposited by conventional means such as plating. The conductors 30 through 36 may be patterned by masking and etching, as is well known in the art. The conductors may also be formed by other means such as deposition of a conductive material onto the insulating sheet 37 through a mask, or stamping conductors 30 through 36 from a thin conducting sheet and attaching them to the insulating sheet 37 by means of a bonding adhesive, as is well known. The insulating sheet 37 is preferably made from low loss KAPTON about 4.5 mils thick. The conductors 30 through 36 are configured to have a length L1, a pitch P, a number of turns N and a width W.

Suitable parameters for a preferred embodiment of a quadrafilar grounded helix antenna for operation at about a wavelength $\lambda$ in accordance with this invention are described below. For a resonant broad band antenna the combined helix conductor length L1 plus feed conductor length L2 is 1.0 $\lambda$. The upper diameter D1 is 0.15 $\lambda$ and the lower diameter D2 is 0.43 $\lambda$. The height H between the upper diameter D1 and lower diameter D2 is 0.5 $\lambda$. The conductors 30–36 are configured such that the number of turns N about the axis 38 is ¾ turns. The conductors 30–36 are formed of plated copper and having a thickness about 1.5 mils. The copper is plated on the insulating sheet 37. The sheet 37 is processed as a planar surface for plating and masking. The conductors 30–36 are masked and etched, having a width W of about 0.2 inches . The sheet 37 is formed into the frustum by suitable cutting and forming as is well known in the art.

The feed conductors 40–46 are formed as tabs having a length $L_2$ 0.075λ, continuously extending from the top end of conductors 30–36. The feed conductors 40–46 overlay KAPTON tabs 37*d,e,f,g* which extend from the sheet 37 and provide mechanical support for the feed conductors 40–46.

The inner ends of the feed conductors 40–46 are attached to the upper ends of the feed rods 50–56 respectively by an attachment means such as screws (not shown) and holes (not shown) provided in the inner ends of feed conductor 40–46 and the upper ends of the feed rods 50–56.

Figure 3A:
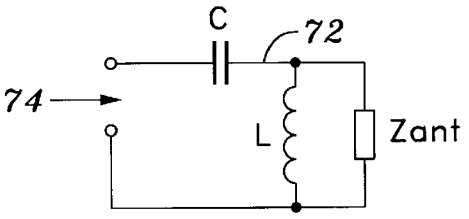
FIG. 3A is a schematic of an equivalent circuit for matching and balancing RF signals to and from the antenna of FIG. 3.
Figure 3:
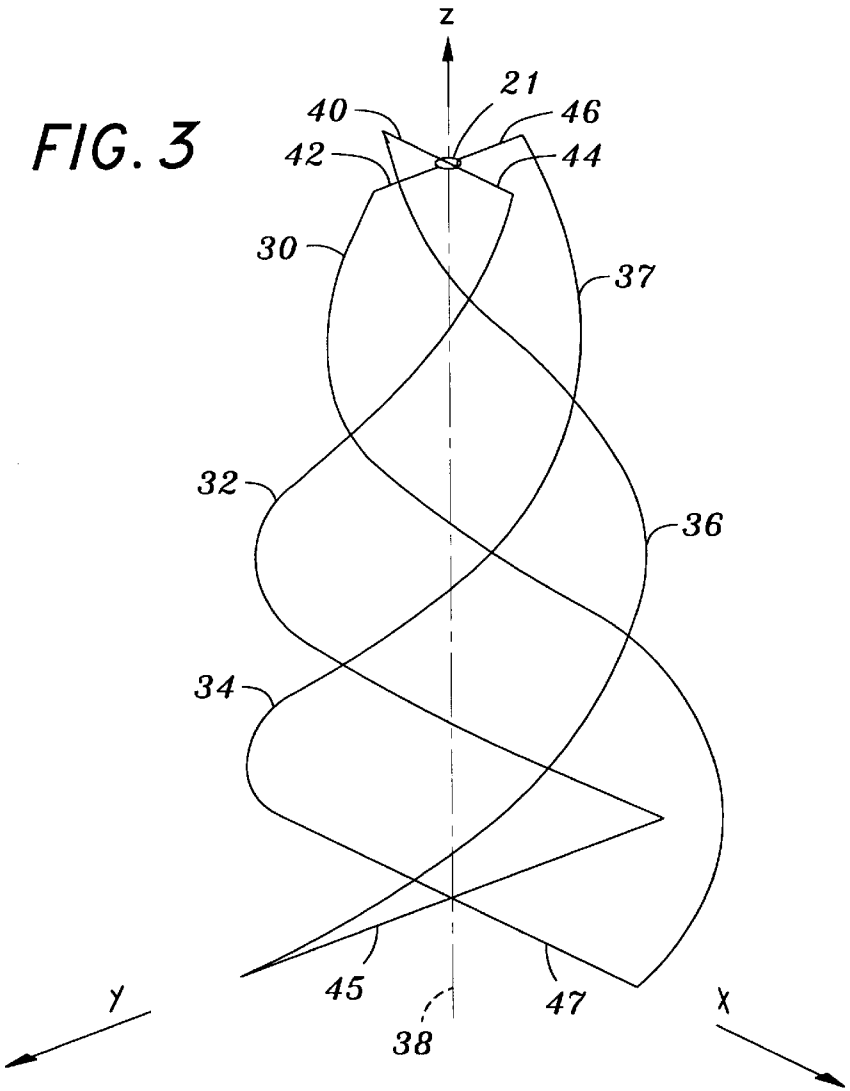
FIG. 3 is a perspective view of a previous art quadrafilar helical antenna.

With reference to FIG. 2, there is shown an equivalent circuit 75 of the feed network 49. The antenna of FIG. 1 is geometrically the same as the antenna of FIG. 3 except that the crossing conductors 45, 47 of FIG. 3 are replaced in FIG. 1 with the ground plane member 60. The ground plane member 60 has a diameter Dg of 0.86 λ and is connected to the bottom ends of the helix conductors 30–36. The feed network 49 provides a means for transforming the balanced four phase signals from the antenna 20 to an unbalanced coaxial line. The elements of the circuit 75 are selected to transform the impedance of the antenna 20 at wavelength λ from 176−j183 ohms to 50+j0 ohms at an input point 74 when the antenna 20 is mounted in free space, ie without a nearby conductive mounting plane such as a vehicle roof top. This corresponds to a VSWR of 1.0 and thus zero reflected power and zero loss. When the antenna 20 is mounted with the ground plane member 60 spaced 0.1 inches away from an infinite ground plane (not shown), the antenna impedance changes to 165−j174 ohms. The impedance of the combined matching network 75 and antenna 20 changes to 48.48+j3.71 ohms at the input 74 to the network 72. This causes an increase in VSWR at the input from 1.0 to 1.09 which is equivalent to a mismatch loss of 0.05 dB.

It can be seen that the addition of the ground plane member 60 of the antenna 20 significantly reduces the loss by almost 0.5 dB caused by VSWR changes due to adjacent grounds. The reduced loss provides increased margin for meeting system G/T and EIRP requirements with a given antenna geometry. Alternately, the antenna geometry may be modified to optimize some parameter, such as antenna height, by taking advantage of the trade off of decreased height for reduced loss at the horizon. In this particular embodiment, the antenna height has been reduced by taking advantage of the reduced mismatch loss under the conditions of nearby adjacent grounds.

The above embodiment of the present invention provides a design which provides a radiation pattern that will optimize characteristics of the antenna by accounting for the presence of a nearby ground rather than ignoring it as has been done in prior art.

ADDITIONAL IMPROVEMENT IN ACCORDANCE WITH THE PRESENT INVENTION

Figure 4A:
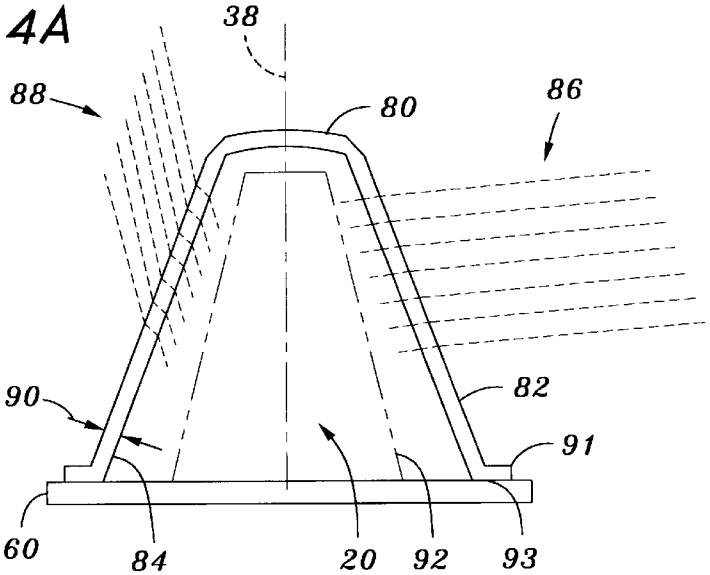
FIG. 4A is a frontal elevation cross section of a quadrafilar helix antenna enclosed by a quasi-elliptical dome.
Figure 4B:
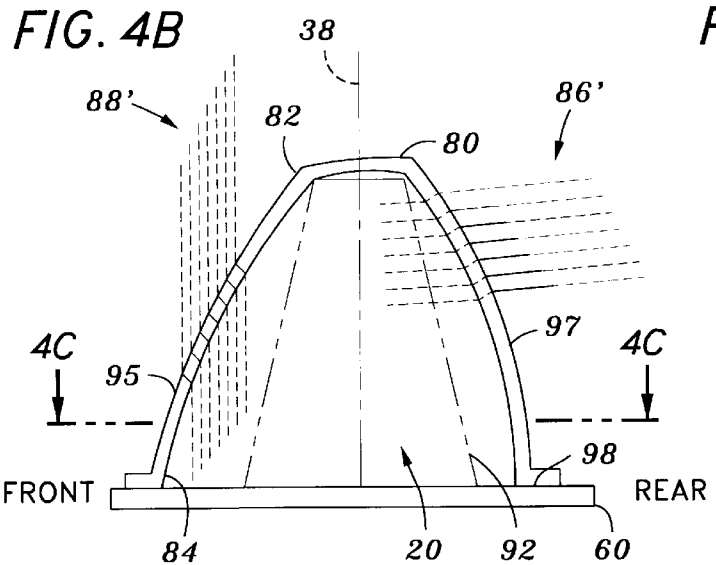
FIG. 4B is a side elevation cross section of a quadrafilar helix antenna enclosed by a quasi-elliptical dome.

With reference to FIG. 4A and FIG. 4B there are shown front and side elevation cross section views, of one embodiment of a housing or dome 80 mounted to enclose the antenna helix 20. The dome 80 is a quasi-ellipsoidal frustum which subtends an upper hemisphere enclosing the antenna 20. The dome 80 is made of a low loss, high strength dielectric such as "XENOY" 5220U made by General Electric Corp. Pittsfield Mass. "XENOY" 5220U is a low loss copolymer polyester and polycarbonate resin material having a dielectric constant of 3.5 at L-band (0.4–1.55 GHz), and has a high strength modulus. For operation at the wavelength λ corresponding to INMARSAT and GPS frequency, the dome 80 is molded as a shell having substantially uniform thickness 90 of 0.2 inches between an outer surface 82 and an inner surface 84.

Figure 4C:
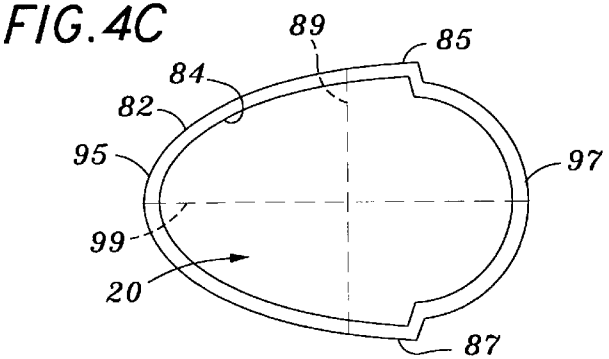
FIG. 4C is a plan cross section of a quadrafilar helix antenna enclosed by a quasi-elliptical dome along line 5C—5C.

With reference to FIG. 4C, there is shown a representative plan cross-section of the dome 80. The plan cross-sections of the dome 80 include forward facing semi-ellipse sectors 95 joined to rearward facing semi-circular sectors 97 joined by curved section 85, 87. The ellipse sectors 95 have minor to major axis (89, 99) ratios of about 0.46. The sectors 95 and 97 taper smoothly from a base 98 to the top of the dome 80. The dome 80 is configured such that the inner surface 84 is spaced away from the helix outer surface 92 by the thickness 90. The major axis 99 of the dome 80 is aligned along the direction of travel of the vehicle to which it is mounted. The dome 80 thus presents a streamlined figure which tends to reduce wind resistance.

A mounting flange 91 is provided extending radially outward from the base 98. Mounting holes in the flange 91 and receiving holes (not shown) in the ground plane 60 are provided for mounting the dome 80 and the ground plane member 60 to a vehicle (not shown) such as a truck cab or car top.

The addition of the dome 80 having a thickness 90 of 0.2 inches to enclose the helix 20 provides an improvement in low elevation angle antenna gain, as explained below.

Electromagnetic rays, indicated by numeral 86 and 86', at low elevation angles will be refracted by the dome 80 in such a way as to make the antenna 20 appear to be electrically taller, thereby presenting an improved gain at low elevation angles, ie, near the horizon. On the other hand, electromagnetic rays at high elevation angle, indicated by numeral 88 and 88', will be refracted such that the antenna 20 will appear electrically shorter, with lower gain toward the zenith.

The resulting change in gain profile allows the antenna 20 to be shorter in height for a given gain requirement at low elevation angle. This feature of the invention is shown in greater detail with reference to FIG. 5C and FIG. 5D. FIG. 5C shows a graph of antenna gain at a constant elevation angle of 0 degrees, covering the horizon from an azimuth of −180 to +180 degrees. The azimuthal angle is measured with reference to the forward facing major axis 99. The antenna gain with the dome 80 is about ½ dB higher than the gain without the dome. FIG. 5D shows a graph of antenna gain vs elevation angle taken along an azimuth of 0 degrees, ie, a plane intersecting the dome major axis 99 and the helix central axis 38. The elevation angle is measured from the zenith, ie overhead to + and −180 degrees. Again, there is shown an improved gain of about ½ dB at the horizon (+ and −90 degrees from the zenith). There is also shown an decreased gain at the zenith as predicted. To recapitulate, the addition of a dome 80 having a suitable thickness 90 and dielectric constant of 3.5 provides an improved low elevation angle gain for the helix antenna 20.

As before described, the improved low angle gain may be traded with reduced helix height, to provide an antenna system having a reduced height with a fixed minimum G/T requirement at low elevation angle.

A dome having a different shape may be used with similar results. Measurements made with a "XENOY" dome having a uniform hemispherical shape and a thickness 90 of 0.2 inches shows similar improvement in low elevation angle gain.

It is contemplated that different combinations of dome 80 materials and thickness 90 may be used to provide the desired increase in low elevation angle gain.

The increased low angle gain provided by the dome 80 provides a means to reduce the height of the combination of the antenna 20 and the dome 80 while maintaining the desired minimum gain profile required by the INMARSAT-C specification.

The height of a preferred embodiment of the combination of antenna 20 enclosed in dome 80, is apportioned as listed in Table 1. The height is referenced from the top of the ground plane 60 as illustrated in FIGS. 5A–5E for a design center frequency of 1575 MHz.

TABLE 1

| item | description | size |
|---|---|---|
| 1 | height from top of ground plane 60 at diameter D2 to top of helix 20 at diameter D1 (1/2 λ at 1595 MHz) | 94.0 mm (3.70 inches) |
| 2 | space from top of helix 20 at diameter D1 to inner surface of dome 80 | 1.36 mm (.053 inches) |
| 3 | thickness of dome 80 | 5.08 mm (.20 inches) |
| total | height from top of ground plane 60 to top of dome 80 | 100.44 mm (3.95 inches) |

ADDITIONAL IMPROVEMENT IN ACCORDANCE WITH THE PRESENT INVENTION

Figure 5:
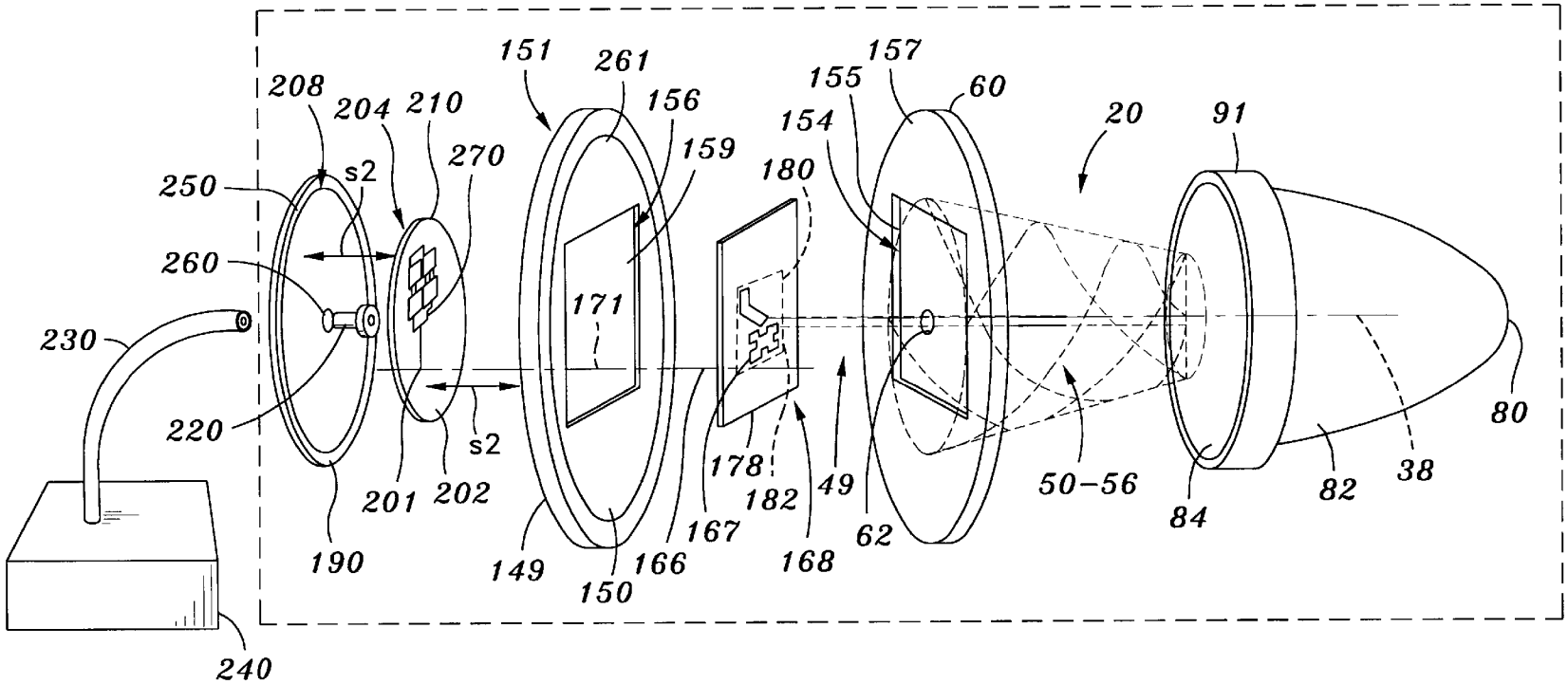
FIG. 5 is an exploded perspective view of an integrated quadrafilar helix antenna system in accordance with this invention.
Figure 6:
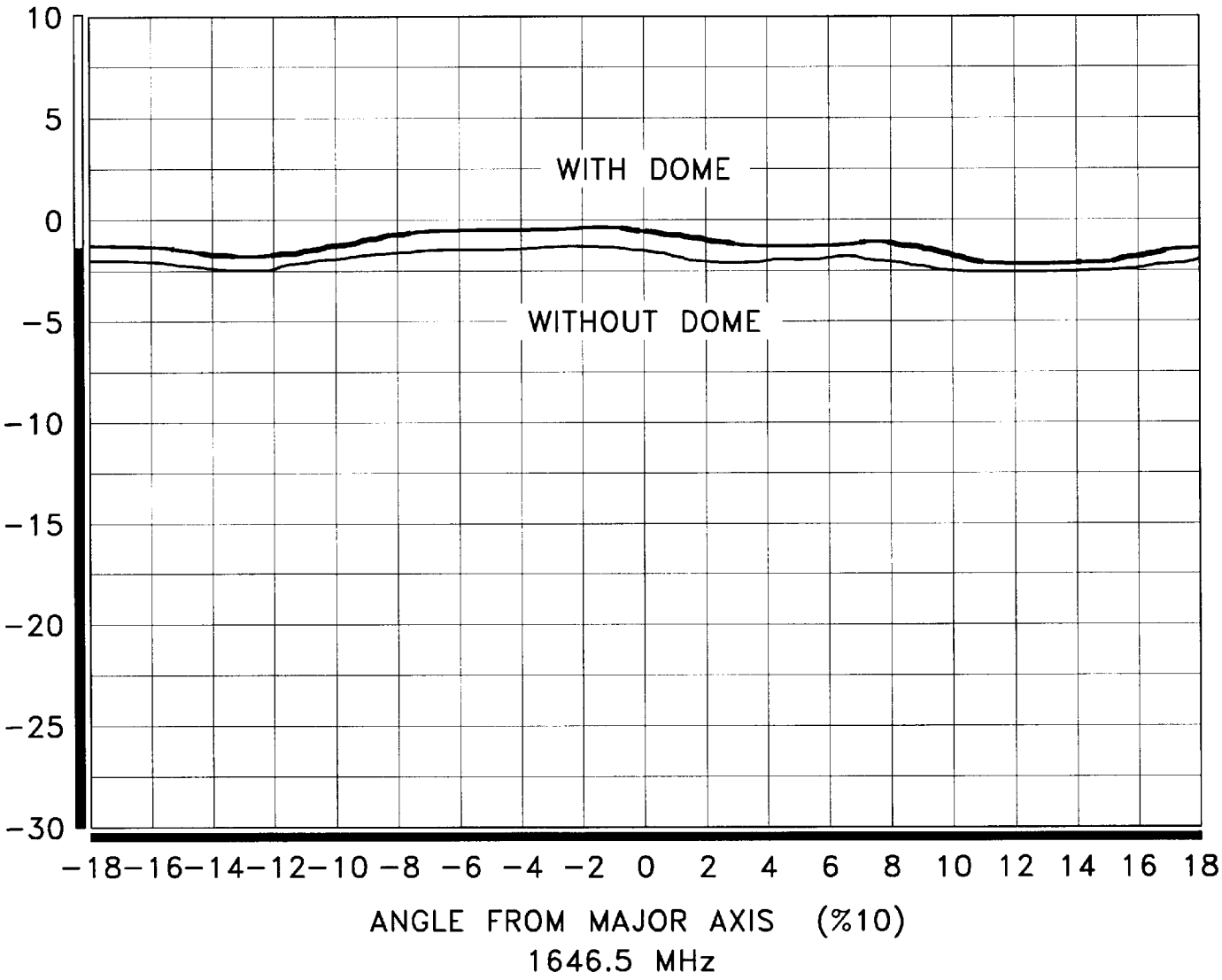
FIG. 6 is a graph of antenna gain vs azimuthal angle at a constant elevation angle of 0 degrees.
Figure 7:
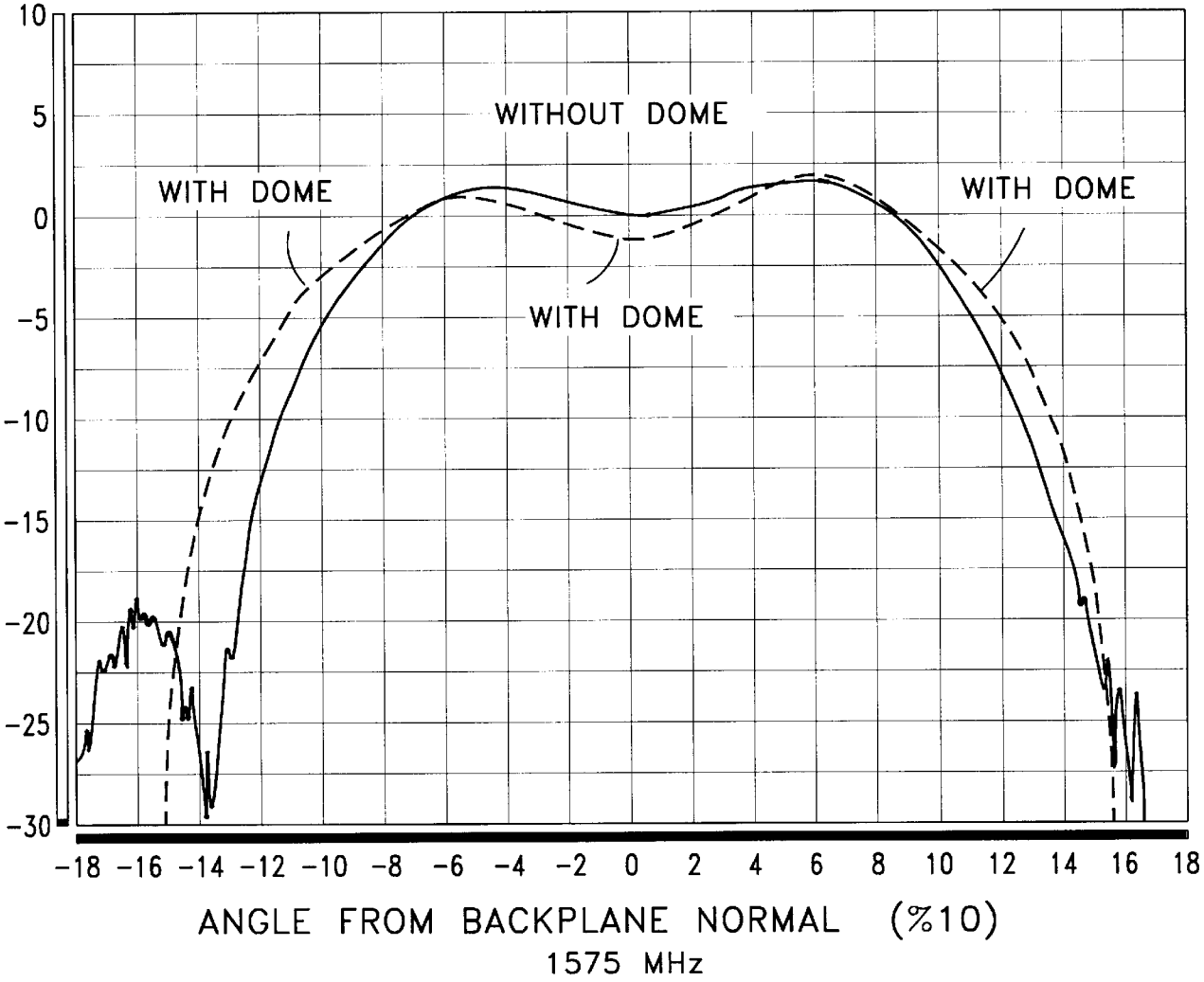
FIG. 7 is a graph of antenna gain vs elevation angle at a constant azimuth of 0 degrees.

With reference to FIG. 5, there are shown additional aspects of an embodiment of a reduced height helical antenna system generally indicated by the numeral 100. The system 100 provides a reduced height helical antenna system having specified G/T and EIRP performance parameters at a connector point suitable for connecting to a remotely mounted display and signal processing unit. A preferred embodiment of the invention specifically meets the requirements of the INMARSAT-C system.

The integrated helical antenna system 100 includes the helical antenna 20, the ground plane member 60, and the dome 80 as shown and described with reference to FIGS. 1, and 4A–4C. The helix 20 and dome 80 are oriented above, or toward the zenith with reference to the ground plane member 60. The feed network generally indicated by the numeral 49 includes the feed rods 50–56 and a power splitter and impedance matching network herein referred to as a balun/quadrature splitter (BQS) board 168 and further described below.

In a preferred embodiment, the through holes 184 are about 0.02 inches in diameter and the sidewalls 188 are plated through, formed with the copper plating and Pb/Sn coating of the conductor layers 170, 172. The close spacing of the holes 184 and the sidewalls 188 prevent RF electric fields within the dielectric of the substrate 178 along the arms 330, 340, 350 and thereby minimizes dielectric loss for this portion of the quadrature splitter circuit 182. Decreased loss contributed by this aspect of the invention provides additional margin for trading height reduction of the helix 20 versus low angle elevation gain as discussed above.

A second ground plane member 149 having an upper surface 150 and a lower surface 151, is mounted below the first ground plane member 60 with the BQS board 168 mounted therebetween. The integrated antenna system 100 further includes a level controlled transmit/receive (TR) electronics board 210, a bottom cover plate 190 and a coaxial connector 220 of conventional design. The coaxial connector 220 provides connection for RF signals passing to and from a coaxial cable 230 of suitable length for connecting to a remotely mounted RF signal processing and display unit 240.

The combination of the novel low loss $S^3$ transmission line BQS board 168, the emitter bias current forward power level controlled TR board 210, the extended ground plane 60 and the grounded helix 20 provides an integrated low profile antenna system 100 of reduced height which can be mounted at an extended distance from an external signal processing and display unit 240.

The BQS board 168 is mounted perpendicular to the central axis 38, in a parallel, spaced apart relationship between an upper ground plane 154 and a lower ground plane 156. The upper ground plane 154 is defined by a recess 155 provided in a bottom facing surface 157 of the ground plane member 60. The lower ground plane 156 is defined by a second recess 159 provided in the upper facing surface 150 of the ground plane member 149.

An electrical connection 166 projects axially below the BQS board 168. One end of the connection 166 connects to an input 167 of a quad splitter circuit 182. The connection 166 extends through the lower ground plane 156 by means of a coaxial transition bore 171 provided therethrough. The other end of the connection 166 connects to a junction 201 provided on a top surface 202 of the TR board 210.

The TR board 210 is formed of a dielectric sheet such as the low loss, controlled dielectric epoxy fiberglass, "GETEK" material made by General Electric Corp. of Pittsfield, Mass. The board 210 is coated with conductor material and masked to produced microstrip circuit patterns as is known in the art and further described below. In a preferred embodiment the board 210 is about 28 mils thick, coated with a first layer of about 1.3 mil copper, a second layer of about 0.5 mil copper and final layer of up to about 500 micro inch Pb/Sn solder.

The TR board 210 is mounted perpendicular to the central axis 38, in a parallel, spaced apart relationship between a lower surface 151 of the ground plane 149 and an upper surface 208 of the cover plate 190, below the TR board 210. The TR board 210 is spaced away from the upper surface 208 and the lower surface 151 by a sufficient distance s2 to minimize de-tuning effects. In a preferred embodiment for operation at a center frequency of 1595 MHz, the spacing s2 is about 0.25 inches.

The cover plate 190 and the lower ground plane 149 define a periphery 250 enclosing and surrounding the TR board 210. The cover plate 190 and plane 149 are configured such that the periphery 250 provides a weather tight, electrically conductive seal for the TR board 210 between the cover plate 190 and the plane 149.

The lower ground plane 149 and the ground plane 60 define a second periphery 261 enclosing and surrounding the BQS board 168. The lower ground plane 149 and the ground plane 60 are configured such that the second periphery 261 provides a weather tight, electrically conductive seal for the BQS board 168 between the lower ground plane 149 and the ground plane 60.

The connector 220 is mounted to the bottom surface 204 of the TR board 210. The coaxial connector 220 projects through an axial bore 260 provided in the cover plate 190. The connector 220 is configured to connect RF signals passing to and from the cable 230 to an RF path 270 on the board 210.

The BQS board 168 of the embodiment of the antenna system 100 provides two advantages over previous matching and power splitting circuits for integrated helical antennas.

The first advantage is a reduced dielectric loss in the circuitry preceding a first receiving preamplifier stage (described below) by using a novel strip line conductor configuration. The second advantage is an improvement in uniformity of azimuthal pattern symmetry provided by a modification of physical balun length.

Figure 8:
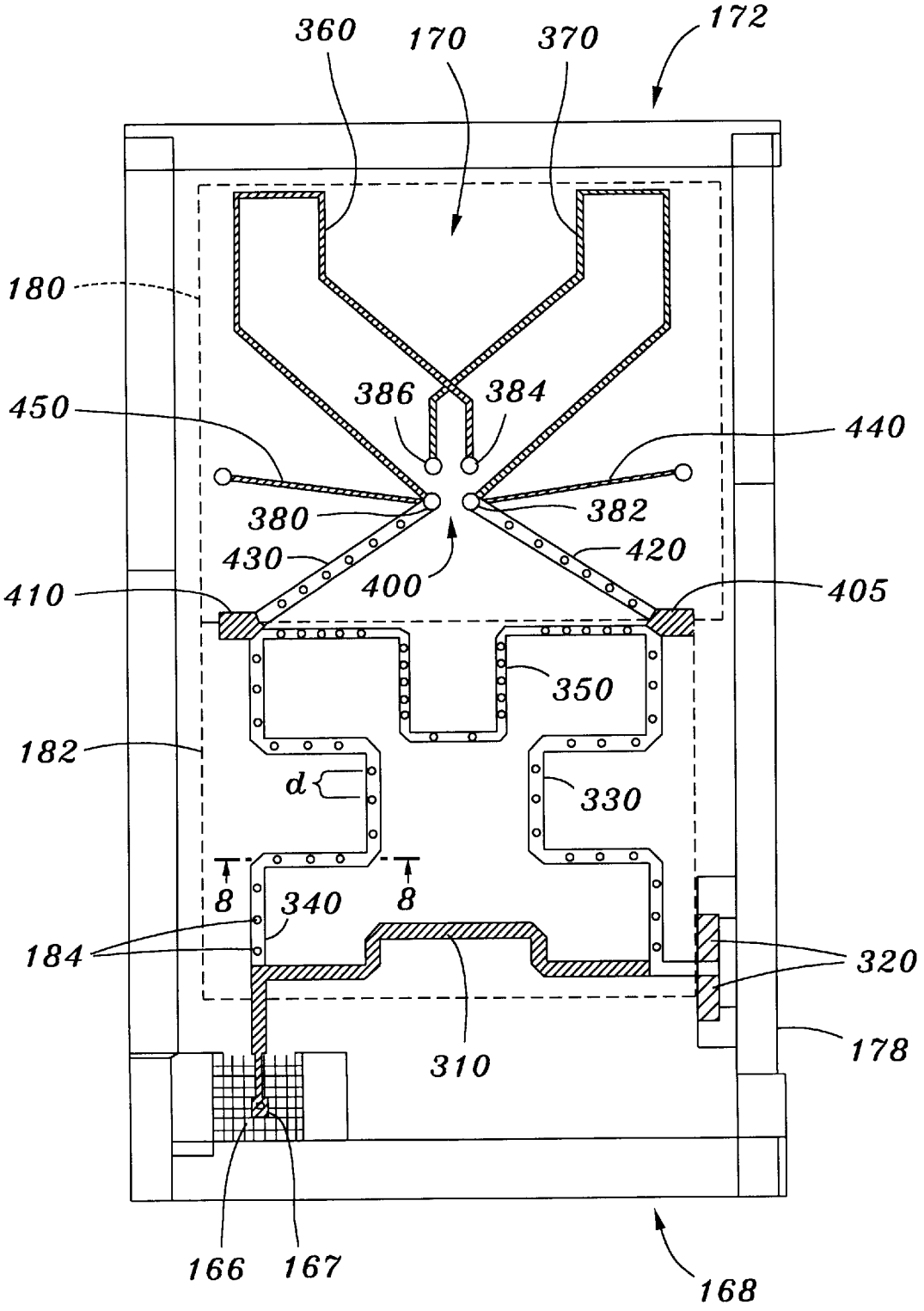
FIG. 8 is a plan view of an $S^3$ power splitter circuit board in accordance with this invention.

With reference to FIG. 8 there is shown a top view of the BQS board 168 having a substrate 178 with conductor layers generally indicated by the numerals 170 and 172 on opposite sides of the substrate 178. The board substrate 178, conductor layers 170, 172 and ground planes 154 and 156 (shown in FIG. 5) are configured to provide a phase shifted, quadrature power splitter circuit 182 feeding an impedance matched power divider balun circuit 180.

The solid filled in patterns in FIG. 8 indicate conductors formed from the top conductor layer 170. The cross hatched patterns indicate conductors formed from the bottom side conductor layer 172. The other patterns indicate double sided conductor patterns. The conductor layers are 1 oz. copper plated (about 1.3 mil thick) on each side of the substrate 178 and are masked and etched by conventional means. Feed through holes, (described below) are provided and plated through with additional conductive material such as copper about 0.5 mils thick. The conductor layers 170, 172 are preferably plated with an additional coating of Pb/Sn about 500 micro inches thick.

The substrate 178 is made from a controlled impedance insulating sheet having a dielectric constant of about 3 and a thickness of about 14 mils. A preferred substrate is glass filled epoxy such as "GETEK".

For operation at a wavelength $\lambda$, the layers 170, 172 are configured by masking and etching to form the quadrature power splitter circuit 182. The splitter circuit 182 includes a meandering ¼ $\lambda$ 50 ohm single strip-suspended-substrate ($S^2$) input arm 310, two symmetrically disposed meandering ¼ $\lambda$ double shorted-strip-suspended-substrate ($S^3$) 35 ohm side arms 330, 340 and a meandering ¼ $\lambda$ 50 ohm $S^3$ output arm 350. For the purposes of this discussion, reference to pattern length in terms of wave length $\lambda$, refers to the effective electrical length, not the physical pattern length in the plane of the substrate 178. The adjustment to be made between physical and electrical length due to the dielectric constant of the substrate 178 material is well known in the art.

The input arm 310 is a single strip suspended substrate ($S^2$) line formed from the top conductor layer 170. The arm 310 is fed at one end from the connection 166 through a short section of covered 50 ohm microstrip in series with a short section of 50 ohm $S^2$ transmission line. The other end of the input arm 310 connects to ground through 50 ohm terminating resistors 320. One end of each respective side arm 330, 340 is connected to a corresponding opposite end of the input arm 310. Each respective other end of the side arms 330, 340 connect to a corresponding opposite end of the output arm 350.

The suspended substrate strip line ($S^2$) and microstrip transmission lines of the circuits 180 and 182 are described in *Handbook of Microwave Integrated Circuits,* Reinmut, K Hoffman, Artech House, Norwood, Mass. 1987 pp 332–3 herein incorporated by reference. See also, *Transmission Line Design Handbook,* Waddell, Brian C., Artech House, Boston, Mass. 1991 herein incorporated by reference.

The circuit board 168 with conductor layers 170 and 172 on opposite sides 174 and 176 mounted within the cavity 152 between the plane conductive surface portions 154 and 156 form a high-Q double-strip suspended substrate transmission line structure. See, for example, "*Handbook of Microwave Integrated Circuits*" op. cit. pages 333 to 336.

Figure 9:
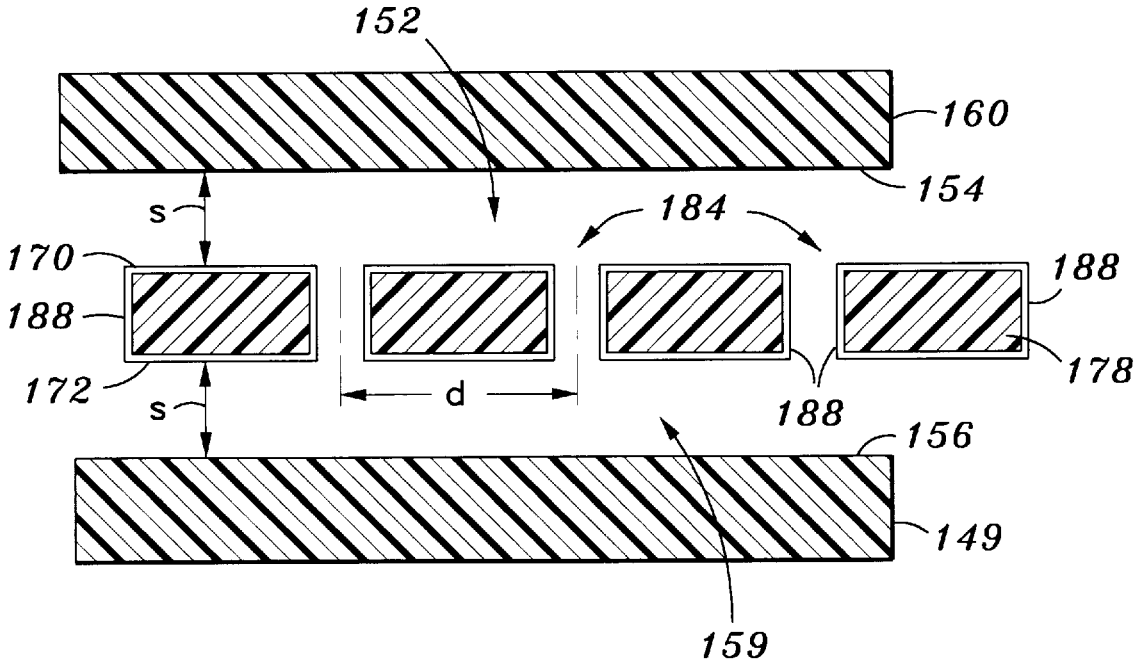
FIG. 9 is a detail cross section along line 8—8 showing through holes and shorting members of the $S^3$ circuit board in accordance with this invention.
Figure 10:
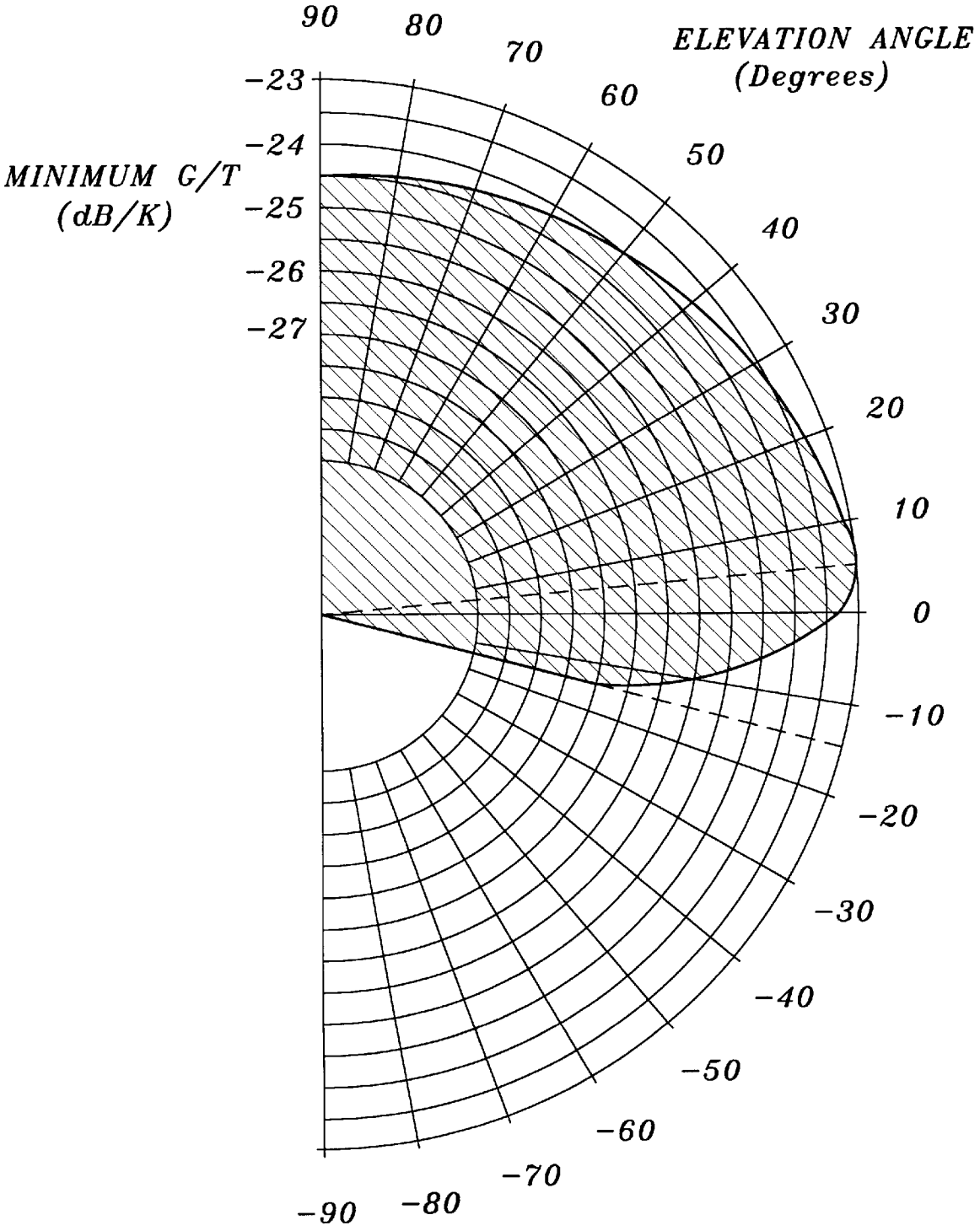
FIG. 10 is a graph of the SDM manual specification for minimum G/T.
Figure 11:
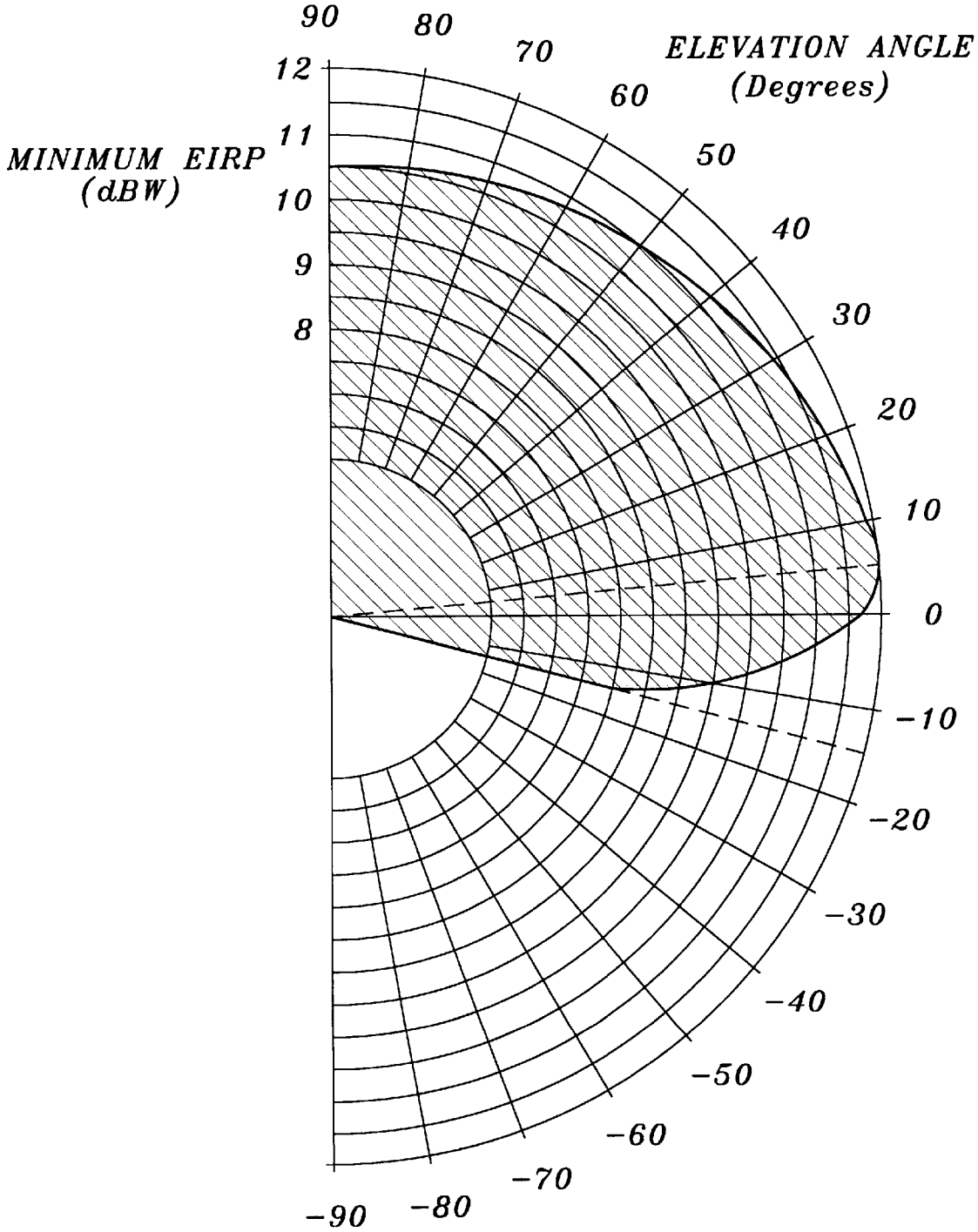
FIG. 11 is a graph of the SDM manual specification for minimum and maximum EIRP.

With reference to FIG. 9, a unique feature of the present invention is providing the substrate 178 with successive through holes 184 aligned along coincident overlaying portions of the conductor layers 170 and 172 on opposed sides 174 and 176 of substrate 178. The contiguous portions of patterns 170 and 172 are connected by shorting members 188, within the through holes 184. This portion of the signal conditioning circuit 168 are termed shorted-strip-suspended-substrate circuit ($S^3$) transmission lines.

With reference to FIGS. 8 and 9, the side arms 330, 340 and the output arm 350 are configured of novel double shorted-strip-suspended-substrate ($S^3$) transmission lines. The conductor layers 170, 172 of the congruent patterns of the $S^3$ transmission lines of the arms 330, 340 and 350 are shorted together by a multiplicity of through holes 184 and conducting sidewalls 188. The through holes 184 are spaced apart no more than a distance d=0.02 $\lambda$. The through holes 184 and conducting sidewalls 188 may be formed by conventional drilling and plating means. In a preferred embodiment, the through holes 184 are about 0.02 inches in diameter and the sidewalls 188 are plated through, formed with the copper plating and Pb/Sn coating of the conductor layers 170, 172. The close spacing of the holes 184 and the sidewalls 188 prevent RF electric fields within the dielectric of the substrate 178 along the arms 330, 340, 350 and thereby minimizes dielectric loss for this portion of the quadrature splitter circuit 182. Decreased loss contributed by this aspect of the invention provides additional margin for trading height reduction of the helix 20 versus low angle elevation gain as discussed above.

In the preferred embodiment of this invention, the through holes 184 are formed by conventional printed circuit fabrication means such as drilling. The shorting members 186 are formed at the time of plating the conductive material for the conductor layers 170 and 172.

FIG. 9 illustrates in cross section the substrate 178 suspended between the ground planes 154 and 156. The through holes 184 are shown spaced apart a maximum distance d. The shorting members 186 are shown as plated through side walls. Distance d is arranged to be small compared to the wavelength of the RF signals in operation. The shorting members 186 between the coincident portions of overlaying conductor layers 170 and 172 keeps the electric field within the dielectric substrate 178 between the coincident overlaying portion of conductor layers 170 and 172 essentially at zero. This reduces the dielectric loss within the substrate over that from the conventional double-strip suspended-substrate technique of the previous art. The lower dielectric loss of the $S^3$ portion of the circuit 168 in accordance with this invention, provides an antenna system with reduced loss and improved gain over that of antennas having conventional suspended-substrate circuits.

An additional advantage of this invention is eliminating the influence of the conductive elements of the signal connection circuit board 168 on the radiation pattern uniformity by mounting them within the recesses 155, 159 between the ground planes 154 and 156. The previous art shows circuitry mounted above the ground plane or within the antenna helix.

The integration of the balun 180 and quadrature splitter 182 within the shielding ground planes 160 and 149 provides a helix antenna system having a lower profile than previous art antennas with integrated electronics.

It is also an advantage in accordance with this invention to orient the ground planes 160 and 149 containing the signal connection circuit board 168 perpendicularly to the antenna axis 38, whereby the height of the antenna system is minimized.

The essentially uniform rotational symmetry of the antenna helix 20 and ground plane 160 provides minimum distortion to a rotationally uniform radiation pattern compared to previous art antennas having signal connection circuitry mounted within or adjacent to the helix conductor elements.

FIG. 9 shows in detail the spacing s between the conductors 170, 172 and the respective ground planes 154, 156 described above. The spacing s in a preferred embodiment of the system 100 is 20 mils.

Each end of the output arm 350 is impedance matched to a respective one end of each of two folded electrically ½ λ $S^2$ 70 ohm balun lines 360, 370. One balun line 360 is formed from the top conductor layer 170. The other balun line 370 is formed from the bottom conductor layer 172 of the substrate 178 and thus may cross over balun line 360 without shorting. The respective one end of each balun line 360, 370 is located on one of two adjacent corners 386, 382 of a quadrilateral 400. Each other end of each respective balun line 360, 370 is located on the respective opposite diagonal corner 380, 384 of the quadrilateral 400. Each adjacent corner and opposed diagonal corner of the quadrilateral 400 is provided with a respective plated through hole through the substrate 178. Each plated through hole of quadrilateral 400 makes electrical contact between the respective one end of top pattern 170 and respective bottom pattern 172. Each plated through hole of quadrilateral 400 is configured to receive one of the bottom ends of the respective feed rods 50, 52, 54, 56 shown in FIGS. 1 and 5. The quadrilateral 400 has an edge length of about 0.16 inches.

The impedance matching from 35 ohm at the each end of the output arm 350 to the 70 ohm of the respective one end of each of the balun lines 360, 370 is provided by a respective parallel capacitive stub 405, 410 at the each end of the output arm 350, a respective 70 ohm $S^3$ transmission line section 420, 430 connecting between the respective each end of the output arm 350, and the respective one end of the balun lines 360, 370. One end of a respective 100 ohm shunt inductive line $S^2$ section 440, 450 is connected to each one of the respective one end of the balun lines 360, 370. The other end of the respective shunt sections 440, 450 is shorted to ground.

The balun lines 360, 370 provide the additional power splitting and impedance matching needed to supply the orthogonal bifilar helices 30, 34 and 32, 36 of the antenna 20 shown in FIG. 1 with equal amplitude, and quadrature phase shifted RF signals to and from the 50 ohm input connection 166.

The corners of the meandering and folded transmission lines are mitred at 45 degrees as is known in the art.

It should be noted that the electrical path length of the balun line 360 and balun line 370 must be equal to achieve the desired equal power splitting, quadrature phase shift to the bottom ends of the feed rods 50, 52, 54, 56 and thus to the helix elements 30, 32, 34, and 36 shown in FIGS. 1 and 5.

For optimum performance of the antenna system 100, it is desired that the azimuthal gain pattern be symmetrical and uniform. It is one aspect of the invention to improve uniform azimuthal gain by decreasing the physical pattern length of the balun line 370 by an amount sufficient to compensate for the additional path length caused by the two through holes at the diagonal corners 382, 386 through the substrate 178 such that the electrical path length of the balun line 370 on the board 168 is the same as the electrical path length of the line 360. In the preferred embodiment of the antenna system 100, for a center frequency of 1575 MHz, corresponding to a wavelength λ of 19.03 cm, the physical pattern length of the bottom side balun line 370 is decreased by about two times the board thickness or 28 mils from that of the top side balun line 360.

The difference in the physical length of balun line 370 from that of balun line 370 improves the uniformity of the azimuthal pattern of the antenna system 100 by about ½ dB. This improvement correspondingly allows the additional height reduction of the antenna system 100 to be achieved while maintaining the minimum G/T requirement of the INMARSAT-C specification.

AN ADDITIONAL IMPROVEMENT OF THE PRESENT INVENTION

Figure 12:
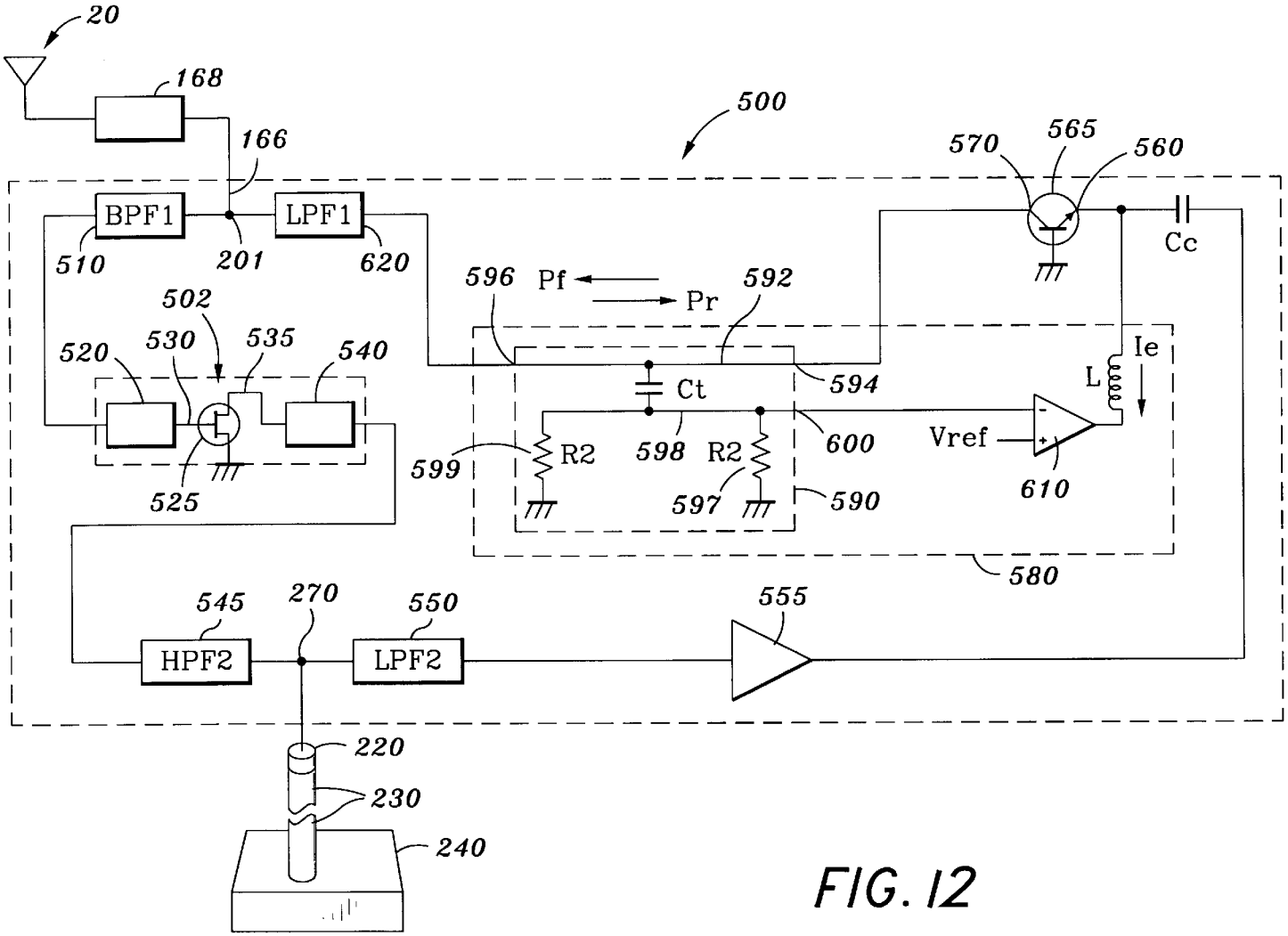
FIG. 12 is a schematic diagram of the TR board in accordance with this invention.

With reference to FIG. 12, there is shown a schematic of the TR board 210 of the antenna system 100 of FIG. 5 and generally indicated by the numeral 500. The TR board 210 includes several features which complement the other aspects of the invention.

Firstly, the TR 210 board includes a level controlled power amplifier stage which maintains nearly constant power output during transmission. This feature removes transmitter power variation from concern with regard to the margin between minimum and maximum EIRP as defined by the INMARSAT-C specification. Therefore the entire EIRP margin may be allocated to the variation caused by the other components of the antenna system 100.

Secondly, the TR board 210 includes a first signal amplification stage 502. The amplification stage 502 is provided with sufficiently low noise figure and sufficient gain, that in combination with the gain profile of the helix 20, the BQS board, and the dome 80 in the configuration of FIG. 5, such that, up to 10 dB of cable loss between proximal and distal ends of a cable 230 connecting the antenna system 100 to a remote display and processing unit 240, may be accommodated, while providing the G/T performance requirements of the INMARSAT-C specification at the distal end of the cable 230. The G/T requirements of the specification are provided by the antenna system 100 of this invention while providing increased flexibility of mounting for the antenna system 100 over the previous art.

The RF signals in the receive band from the antenna 20 are connected to the TR board 210 by the connection 166. The one end of connection 166 connects to the BQS board 168. The other end of connection 166 connects to the conduction pattern on the TR board at the junction point 201. Junction point 201 is configured to provide a matched transition from the coaxial connection 166 to microstrip on the board 210. Conduction patterns on the board 210 are configured as microstrip conductors as previously described.

Received signals pass from the junction point 270 to an input of a band pass filter 510. The signals pass through the filter 510 to an output 515 connected to an input bias network 520. The signals pass through the input network 520. Network 520 is configured to bias a low noise microwave FET signal amplifier transistor 525 at a gate input 530.

A suitable FET for a preferred embodiment of the invention is the MGF4310-65, made by Mitsubishi Corp of Japan. The MGF4310 provides about 30 dB gain and a 1.5 dB noise figure at L-band. The gain of the FET 525 is sufficient to reduce up to 10 db of loss introduced by the following cable 230 to a negligible degradation of the G/T performance of the antenna system 100.

The received signals are amplified by the FET 525 and output at a drain 535. The drain 535 of FET 525 is connected through an output bias circuit 540 to a high pass filter 545. The filter 545 passes the amplified and filtered receive signals to the junction 270. The junction 270 is configured to make a transition from microstrip to the coaxial connector 220. Coaxial connectors of type TNC or type N are preferred for the connector 220. The center conductor of the connector 220 acts to supply DC power to the circuit board 210. DC blocking capacitors and power connections are provided (not shown) in the conventional manner known to those skilled in the art. The connector 220 connects the amplified signals to the proximal end of the cable 230.

The amplifier 525 is mounted in close proximity to the BQS board 168. the RF signals from the antenna 20 thus have a short path to follow through the low loss BQS board 168, the connection 166 and microstrip conductors of TR board 210 before being amplified by the low noise transistor 525. Referring again to FIG. 5, it can be seen that the spacing from the RF received signals from the bottom of the helix 20 to the amplifier 525 is the sum of the dimensions shown in Table 2.

TABLE 2

| | item | thickness along central axis |
|---|---|---|
| 1 | thickness of first ground plane 60 from top surface 142 to recess surface 154 | 1.29 mm (.051 inches) |
| 2 | spacing s from surface 154 to top of BQS board | 5.08 mm (0.020 inches) |
| 3 | thickness of BQS board 168 | .356 mm (0.014 inches) |
| 4 | spacing s from bottom of BQS board to recess surface 156 | 5.08 mm (0.020 inches) |
| 5 | thickness of second ground plane 149 between recessed surface 156 and bottom surface 151 | 1.29 mm (0.051 inches) |
| 6 | spacing s2 from bottom surface 151 and top of TR board 210 | 5.08 mm (0.25 inches) |
| 7 | thickness of TR board 210 | .71 mm (0.028 inches) inches) |
| 8 | spacing from the bottom surface 204 of TR board 210 and the top surface 208 of the cover plate 250 | 6.35 mm (0.25 inches) |
| 9 | thickness of the cover plate 250 | 2.03 mm (0.08 inches) |
| | subtotal | 26.56 mm (1.04 inches) |

The overall height of the antenna system 100 is calculated by combining the height above the ground plane 60 given in table 1, with that of the portion below the ground plane 60 given in table 2. The total height of the preferred embodiment of the integrated antenna system 100 for meeting or exceeding the specification requirements of the INMARSAT-C specification is 127 mm.

At the connector 220 the G/T of the antenna system 100 will allow a cable 230 having up to 10 dB of loss (typically 10 meters of low cost RG58U cable) to be introduced between the connector 220 and the processing unit 240 before reaching the minimum limit specified by the INMARSAT-C specification. Longer lengths of lower loss cable may also be provided to further increase the distance between the antenna system 100 and the processing unit 240.

With reference again to FIG. 12, the TR board 210 also includes a level controlled transmitter power amplifier stage, as will be described below, for stabilizing radiated transmitter power to achieve the EIRP requirement of the INMARSAT-C specification.

The components of the TR board 210 are conventionally soldered to portions of conductive patterns provided on the top surface 202. RF signals are conducted between the components by sections of microstrip. Ground and power connections are made in the conventional manner.

Transmitter signals at a frequency of ½ the final transmit frequency are passed from the unit 240 through the cable 230 and are received by the connector 220 and passed through junction 270 to a low pass filter 550. The transmitter signals from filter 550 are connected to an input of a frequency doubling power preamplifier 555. The frequency doubled and preamplified transmitter signal from the preamplifier 555 passes through a blocking capacitor Cb and is presented to an emitter 560 of a grounded base Class-C RF power amplifier transistor stage 565. In a preferred embodiment of the invention, the transistor 565 is a MRA1600-30 made by Motorola, Semiconductor Div. Phoenix. The final RF power signal appears at a collector 570 of the transistor 565.

Class-C amplifiers are discussed in *Electronic Engineers Handbook* 3rd Edition, Fink et al, McGraw Hill, New York, chapter 13 pp 6–7, chapter 14 pp 5–9, herein incorporated by reference.

The filters indicated in FIG. 12 are standard low loss commercial filters having pass band edges suitable for harmonic and out-of-band signal rejection, and are familiar to those skilled in the art.

The flow of RF power in the stages proceeding the final transistor 565 is essentially all in the forward direction, ie toward the antenna, because the impedances of the microstrip on the board 210 and the components are well matched. However, this is not the case for the power flow from the transistor 565 to the antenna 20. Variation of antenna impedance with frequency, though slight, still cause some power to be reflected from the antenna which is not available to contribute to the EIRP. Also, temperature changes due to heating and aging variations in the power output versus power input characteristics of the final transistor 565 would detract from the allowable INMARSAT-C EIRP specification margin.

It is an advantage, for the purpose of providing a reduced height antenna system, to apportion the allowable system variation of EIRP only to the antenna 20 and associated matching circuitry and to limit the variation of EIRP due to the final transistor 565. One limit to the allowable EIRP variation is the minimum value of 10.5 dBW at 5 degrees elevation. The other limit is the maximum allowable EIRP of 16 dbW.

Control of the RF power output for a Class-C power stage is conventionally done by means of controlling the average collector voltage of the power output stage and thus the RF amplitude. The conventional scheme requires a series pass element in the connection between the collector to power supply rail, either a modulating transformer representing an equivalent voltage or a series resistor or pass transistor causing a voltage drop from the power supply rail. These schemes either waste power which is uselessly dissipated in the resistor or pass transistor, or require additional space and weight for a transformer. In either event, additional power must be supplied to the power stage which results in an increased heat load to be dissipated by the power stage.

In the preferred embodiment of the antenna system 100 in accordance with this invention, the power output of the Class-C amplifier stage 565 is modulated by controlling the conduction angle of the emitter current. Controlling the conduction angle is accomplished by altering the bias current, Ie, supplied to the emitter 560 of the transistor 565. Increasing the bias current, Ie, causes the transistor 565 to turn on earlier in the RF conduction cycle and stay on longer in the RF conduction cycle. Alternately, reducing the bias current, Ie, causes the transistor 565 to delay turn on to later in the conduction cycle, and to initiate turn off earlier at the end of the conduction cycle.

Stabilizing the forward power Pf delivered to the antenna 20 is accomplished by sampling the forward power and providing negative feed back to control the bias current, Ie, such that the forward power Pf is maintained at an essentially constant value, independent of changes in the transistor 565 characteristics or changes of the reflected power Pr caused by changes in the antenna 20 impedance or gain with frequency.

Controlling the conduction angle of the emitter current is done at the relatively low impedance of the emitter side of transistor 565 rather than the higher impedance collector side. Lower power dissipation is thereby achieved than in the conventional modulation methods.

Control of the conduction angle by modulating emitter bias current is provided by a transmitter power level control circuit 580. One embodiment of the control circuit 580 includes a ¼ wave microstrip bi-directional coupler 590. The coupler 590 is described by Goux, Pascal, in *RF Design,* published by Argus Inc. Atlanta, Ga., P. pp 40–48, May 1991 which is herein incorporated by reference. The coupler 590 includes an input 594, an output 596, and a coupler main line 592 therebetween. The coupler 590 also includes a sample line output 600, a sample line termination 599, an output terminating resistor 597, and a forward power sample line 598 therebetween, the sample line 598 coupled to the main line 592. The sample line 598 is terminated at each end 599, 600 by a resistor R2 having a value equal to the characteristic microstrip impedance. The coupler 590 provides a sample of the forward power Pf at the sample output 600. The microstrip coupler 590 provides a high degree of directivity, greater than 20 dB, in a compact size.

The coupler lines 592 and 598 are ¼ wave long, 0.055 mil wide lines spaced about 0.55 mils apart. The midpoint of the main line 592 and the midpoint of the sample line 598 are connected by a 0.11 pF capacitor Cc for improved coupling ratio. In a preferred embodiment of the invention the capacitor Cc may be formed by the body capacitance of three 10 meg ohm 1206 (not shown)package type ceramic surface mount resistors having body capacitance of about 0.035 pF each. Package type 1206 ceramic surface mount resistors are available from several suppliers, such as Murata Eire of Symrna, Ga. The resistors are soldered in parallel between the midpoints of the main line 592 and the sample line 598. The coupler is configured in the conventional manner from the conductive layers provided on the TR board 210 to provide a 1% (20 dB down) sample of forward power. For the preferred 50 ohm system, R2 typically is a 51.1 ohm resistor.

The collector 570 is connected to a coupler input 594. Forward power Pf flows into the coupler input 594, through the coupler 590, output 596 and LPF1 filter 620 to the junction 201. Forward power Pf continues through the connection 166 to the antenna 20.

The sample output 600 presents the sample of the forward power Pf being delivered to the antenna 20. An inverting input of a high gain, differential input, current output amplifier 610 is connected to the sample output 600. A non-inverting input of the amplifier 610 is connected to a reference voltage Vref provided by a reference circuit of conventional design (not shown). Vref is selected to provide a desired forward power output level, generally at the midpoint of the allowable window between the maximum 16 dBW and the minimum 10.5 dBW. The amplifier 610 is configured to amplify the difference between the peak RF voltage of the sample of forward power and the reference voltage Vref. The amplifier 610 outputs the bias current, Ie, which controls the bias point and thereby the conduction angle of the transistor 565. The conduction angle controls the total amount of power, Pf+Pr, supplied by the transistor 565. The coupler 590 and amplifier 610 act as a feedback loop controlling the forward power Pf. The gain and transfer characteristic of the amplifier 610 is selected to reduce variations in forward power Pf to essentially zero. Circuits for amplifier 610 and reference voltage Vref are well known in the art.

While the foregoing detailed description has described several embodiments of the low profile helical antenna in accordance with this invention, it is to be understood that the above description is illustrative only and not limiting of the disclosed invention. It will be appreciated that it would be possible to modify the parameters of the helix for different frequency operation, the materials and the methods of manufacture or to include or exclude various elements within the scope and spirit of this invention. Thus the invention is to be limited only by the claims as set forth below.

What is claimed is:

1. An integrated quadrifilar helix antenna system for receiving and transmitting electromagnetic waves of wave length λ, comprising:

four spaced apart helical conductors wound in a common direction, the helical conductors defining a common central axis and helix antenna, the helical conductors each having a top end and a bottom end;

a first ground plane perpendicular to the central axis, the ground plane having a top surface and a bottom surface and a thickness therebetween, the first ground plane extending radially outward at least a preselected distance from the central axis beyond the bottom ends of the helical conductors;

conductive connections connecting the respective bottom ends of the helical conductors to the top surface of the first ground plane;

a dome enclosure having a proximal opening to receive the helical conductors and the conductive connections, the opening configured for mounting to the top surface of the ground plane;

a second ground plane having a second top surface and a second bottom surface and a thickness therebetween, the second ground plane mounted below the first ground plane, the first and second ground planes configured to define a first planar cavity between a recessed portion of the bottom surface of the first ground plane and a second planar cavity between a corresponding recessed portion of the top surface of the second ground plane, the periphery of the first and second ground planes configured to provide an electrically conductive connection surrounding the first and second cavities, the second ground plane providing an input port for transmitting RF signals in and out of the second cavity;

a signal feed having:

a) a signal transmission network having a first connection end and a second connection end, the first connection end for coupling RF signals to the top ends of the corresponding helical conductors, the second connection end passing through the first ground plane feedthrough opening;

b) a signal conditioning circuit including means for impedance matching and power splitting the RF signals to and from the transmission network, the signal conditioning circuit electrically connected to the second connection end of the signal transmission network, the signal conditioning circuit mounted parallel to the ground planes and inside the cavity;

a transmit/receive board having an upper and a lower surface and a thickness therebetween, the transmit/receive board including a low noise preamplifier means for amplifying RF signals from the signal conditioning circuit, the amplifier means having a predetermined gain and noise figure;

a conducting planar cover plate having an upper and a lower surface, the lower surface defining a base plane distal to the helix antenna, the upper surface of the cover plate defining a third cavity recessed from the upper surface of the cover plate, the third cavity configured to receive the transmit/receive circuit board, the circuit board mounted parallel to and spaced apart between the upper surface of the cover plate and the lower surface of the second ground plane, the cover plate mounted perpendicular to the central axis, the cover plate mounted below the second ground plane, the cover plate providing an axial bore therethrough;

a coaxial cable connector for connecting the amplified RF signals from the preamplifier means to a proximal end of a coaxial cable, the cable connector mounted below the lower surface of the transmit/receive board, the connector projecting axially through the cover plate axial bore;

in combination, the elevation and azimuthal gain profile of the helix antenna and the dome enclosure, the signal splitting and impedance matching of the signal conditioning circuit, the gain and noise figure of the preamplifier means each having predetermined characteristics, the antenna system defining an overall height between the top end of the enclosure and the cover plate base plane of about 127 mm;

the antenna system having a G/T profile as measured at the distal end of the coaxial cable, including up to 10 dB of cable loss between the cable distal end and the cable proximal end, which meets the SDM specification;

wherein the first and second ground planes provide a conducting shield between the helical conductors above the ground planes and other conducting elements located below the ground planes such that the cavity between the first and second ground planes providing a suitable containment structure for the signal conditioning circuit effectively isolating the circuit from the antenna helical conductors.

2. An integrated quadrifilar helix antenna system for receiving and transmitting electromagnetic waves of wave length $\lambda$, comprising:

four spaced apart helical conductors wound in a common direction, the helical conductors defining a common central axis and helix antenna, the helical conductors each having a top end and a bottom end;

a first ground plane perpendicular to the central axis, the ground plane having a top surface and a bottom surface and a thickness therebetween, the first ground plane extending radially outward at least a preselected distance from the central axis beyond the bottom ends of the helical conductors;

conductive connections connecting the respective bottom ends of the helical conductors to the top surface of the first ground plane;

a dome enclosure having a proximal opening to receive the helical conductors and the conductive connections, the opening configured for mounting to the top surface of the ground plane;

a second ground plane having a second top surface and a second bottom surface and a thickness therebetween, the second ground plane mounted below the first ground plane, the first and second ground planes configured to define a first planar cavity between a recessed portion of the bottom surface of the first ground plane and a second planar cavity between a corresponding recessed portion of the top surface of the second ground plane, the periphery of the first and second ground planes configured to provide an electrically conductive connection surrounding the first and second cavities, the second ground plane providing an input port for transmitting RF signals in and out of the second cavity;

a signal feed having:

a) a signal transmission network having a first connection end and a second connection end, the first connection end for coupling RF signals to the top ends of the corresponding helical conductors, the second connection end passing through the first ground plane feedthrough opening;

b) a signal conditioning circuit including means for impedance matching and power splitting the RF signals to and from the transmission network, the signal conditioning circuit electrically connected to the second connection end of the signal transmission network, the signal conditioning circuit mounted parallel to the ground planes and inside the cavity;

c) the signal conditioning circuit having:

a shorted suspended strip transmission line network for guiding the RF signals at a frequency f between an input and at least one output within the signal conditioning circuit, the strip line network comprising:

two parallel ground planes defining a cavity therebetween;

a planar dielectric sheet having a thickness, a dielectric constant, a top surface and a bottom surface, the sheet supported within the cavity, the sheet spaced apart from and between the two ground planes;

a first conductive pattern including a first plurality of contiguous strip conductors formed on the top surface of the sheet;

a second conductive pattern formed on the bottom surface of the sheet, the second pattern including a second plurality of contiguous strip conductors, the second plurality of conductors overlaying and essentially replicating the first pattern, thereby defining the strip transmission line network;

the sheet defining a plurality of sequential spaced apart feedthrough holes along at least a portion of the strip transmission line network, the through holes successively separated by at most a maximum spacing distance d, the distance d arranged to be less than a pre-selected submultiple of the wavelength corresponding to the RF signal frequency f, each successive spaced apart through hole having a plated through conductor therethrough, each conductor electrically joining the corresponding first and second conductive patterns around the each through hole, thereby defining the shorted suspended substrate transmission line, wherein the RF signal impressed between the patterns and the ground planes will induce essentially zero RF electric field in the dielectric sheet between the overlaying first and second strip conductors thereby minimizing RF dielectric loss within the sheet, along the shorted suspended substrate transmission line;

a transmit/receive board having an upper and a lower surface and a thickness therebetween, the transmit/receive board including a low noise preamplifier means for amplifying RF signals from the signal conditioning circuit, the amplifier means having a predetermined gain and noise figure;

a conducting planar cover plate having an upper and a lower surface, the lower surface defining a base plane distal to the helix antenna, the upper surface of the cover plate defining a third cavity recessed from the upper surface of the cover plate, the third cavity configured to receive the transmit/receive circuit board, the circuit board mounted parallel to and spaced apart between the upper surface of the cover plate and the lower surface of the second ground plane, the cover plate mounted perpendicular to the central axis, the cover plate mounted below the second ground plane, the cover plate providing an axial bore therethrough;

a coaxial cable connector for connecting the amplified RF signals from the preamplifier means to a proximal end of a coaxial cable, the cable connector mounted below the lower surface of the transmit/receive board, the connector projecting axially through the cover plate axial bore;

the elevation and azimuthal gain profile of the helix antenna and the dome enclosure, in combination with the signal splitting and impedance matching of the signal conditioning circuit, the gain and noise figure of the preamplifier means each having predetermined characteristics;

the first and second ground planes providing a conducting shield between the helix antenna conductors above the ground planes and other conducting elements located below the ground planes such that the cavity between the first and second ground planes providing a suitable containment structure for the signal conditioning circuit effectively isolating the circuit from the antenna helical conductors.

3. An integrated quadrifilar helix antenna system comprising:

four spaced apart helical conductors wound in a common direction, the helical conductors defining a common central axis, the helical conductors each having a top end and a bottom end;

a ground plane perpendicular to the central axis, the ground plane having a top surface that is proximal to and below the bottom ends of the helical conductors, the ground plane extending radially outward at least a preselected distance from the central axis beyond the bottom ends of the helical conductors;

conductive connections connecting the respective bottom ends of the helical conductors to the ground plane, wherein the ground plane provides a conducting shield for terminating electric field lines from the helical conductors;

a signal feed that couples four balanced RF signals from the common central axis to the top ends of corresponding helical conductors, said signal feed having a shorted suspended strip transmission line network for guiding an RF signal at a frequency f between an input and the central axis, the strip line network including:

a conductive plane spaced apart from and parallel to the ground plane defining a cavity therebetween;

a planar dielectric sheet having a thickness, a dielectric constant, a top surface and a bottom surface, the sheet supported within the cavity, the sheet spaced apart from and between the conductive plane and the ground plane;

a first conductive pattern including a first plurality of contiguous strip conductors formed on the top surface of the sheet;

a second conductive pattern formed on the bottom surface of the sheet, the second pattern including a second plurality of contiguous strip conductors, the second plurality of conductors overlaying and essentially replicating the first pattern, thereby defining the strip transmission line network;

the sheet defining a plurality of sequential spaced apart feedthrough holes along at least a portion of the strip transmission line network, the through holes successively separated by at most a maximum spacing distance d, the distance d arranged to be less than a pre-selective submultiple of the wavelength corresponding to the RF signal frequency f, each successive spaced apart through hole having a plated through conductor therethrough, each conductor electrically joining the corresponding first and second conductive patterns around the each through hole, thereby defining the shorted suspended substrate transmission line network, wherein the RF signal impressed between the patterns and the planes will induce essentially zero RF electric field in the dielectric sheet between the overlaying first and second strip conductors thereby minimizing RF dielectric loss within the sheet, along the shorted suspended substrate transmission line.

4. An integrated quadrifilar helix antenna system comprising:

four spaced apart helical conductors wound in a common direction, the helical conductors defining a common central axis, the helical conductors each having a top end and a bottom end;

a ground plane perpendicular to the central axis, the ground plane having a top surface that is proximal to and below the bottom ends of the helical conductors, the ground plane extending radially outward at least a preselected distance from the central axis beyond the bottom ends of the helical conductors;

conductive connections connecting the respective bottom ends of the helical conductors to the ground plane, wherein the ground plane provides a conducting shield for terminating electric field lines from the helical conductors;

a signal feed that couples four balanced RF signals from the common central axis to the top ends of corresponding helical conductors, said signal feed having a suspended strip transmission line dual balun network for transforming two equi-amplitude, unbalanced, quadraphase RF signals at a wavelength $\lambda$ into a first and a second equi-amplitude, balanced, quadraphase RF output signals, including:

a conductive plane spaced apart from and parallel to the ground plane defining a cavity therebetween;

a planar dielectric sheet having a top surface and a bottom surface and a thickness therebetween, the sheet supported within the cavity, the sheet spaced apart from and parallel between the two planes;

a first strip transmission line formed on the top surface of the sheet, the first line having an input end and an output end, and a first electrical length therebetween, providing a half wave phase shift between the input end and output end;

a second strip transmission line formed on the bottom surface of the sheet, the second line having a second input end and a second output end and a second electrical length therebetween;

a first pair of feedthroughs disposed on first diagonal corners of a quadrate equilateral, the feedthroughs penetrating the sheet therethrough, the equilateral defined in the plane of the sheet, the input end and output end of the first strip line each connected to a respective one of the first opposed pair of feedthroughs on the top surface of the sheet, the first pair of feedthroughs thereby defining the first balanced output signal;

a second pair of feedthroughs disposed on opposed diagonal corners of the quadrate equilateral, the second pair of feedthroughs penetrating the thickness of the sheet therethrough, the input end and output end of the second strip line each connected to a respective one of the second opposed pair of feedthroughs on the bottom surface of the sheet;

the second strip transmission line electrical length selected such that the sum of the second electrical length plus the electrical length of the second pair of feedthroughs through the thickness of the sheet provides a half wave phase shift between the second pair of feedthroughs at the top surface of the sheet, thereby defining the second balanced output signal;

a balanced electrical connector that connects the first and second pair of opposed feedthroughs to the top ends of the corresponding helical conductors.

* * * * *

UNITED STATES PATENT AND TRADEMARK OFFICE

CERTIFICATE OF CORRECTION

PATENT NO. : 6,011,524

DATED : January 4, 2000

INVENTOR(S) : James W. Jervis

It is certified that error appears in the above-identified patent and that said Letters Patent is hereby corrected as shown below:

In column 20 at line 8, delete "patterns" and insert --conductor layers--

In column 20 at line 10, delete "168" and insert "168"

Signed and Sealed this

Twenty-seventh Day of March, 2001

*Attest:*

*Attesting Officer*

NICHOLAS P. GODICI

*Acting Director of the United States Patent and Trademark Office*